US009719761B2

(12) United States Patent
Gevedon

(10) Patent No.: US 9,719,761 B2
(45) Date of Patent: Aug. 1, 2017

(54) SAFE FIREARM SYSTEM AND METHOD

(71) Applicant: Hanners Gevedon, Mount Vernon, KY (US)

(72) Inventor: Hanners Gevedon, Mount Vernon, KY (US)

( * ) Notice: Subject to any disclaimer, the term of this patent is extended or adjusted under 35 U.S.C. 154(b) by 0 days.

(21) Appl. No.: 14/467,028

(22) Filed: Aug. 24, 2014

(65) Prior Publication Data

US 2015/0059224 A1 Mar. 5, 2015

Related U.S. Application Data

(60) Provisional application No. 61/870,260, filed on Aug. 27, 2013.

(51) Int. Cl.

| | |
|---|---|
| ***F41C 3/14*** | (2006.01) |
| ***F42B 12/58*** | (2006.01) |
| ***F41A 7/10*** | (2006.01) |
| ***F41A 9/28*** | (2006.01) |
| ***F41A 17/02*** | (2006.01) |
| ***F41A 17/04*** | (2006.01) |
| ***F41A 19/01*** | (2006.01) |
| ***F41A 19/53*** | (2006.01) |
| ***F41C 23/10*** | (2006.01) |

(52) U.S. Cl.

CPC ..... *F42B 12/58* (2013.01); *F41A 7/10* (2013.01); *F41A 9/28* (2013.01); *F41A 17/02* (2013.01); *F41A 17/04* (2013.01); *F41A 19/01* (2013.01); *F41A 19/53* (2013.01); *F41C 3/14* (2013.01); *F41C 23/10* (2013.01)

(58) Field of Classification Search

CPC ..... F41C 3/14; F41C 3/16

USPC ..... 42/59, 62, 65, 66

See application file for complete search history.

(56) References Cited

U.S. PATENT DOCUMENTS

| | | | | | |
|---|---|---|---|---|---|
| 213,221 | A | * | 3/1879 | Mauser | F41A 17/78 42/59 |
| 338,760 | A | * | 3/1886 | Merritt | F41A 9/28 42/59 |
| 688,216 | A | * | 12/1901 | Whiting | F41C 3/14 42/59 |
| 688,217 | A | * | 12/1901 | Whiting | F41C 3/14 42/59 |
| 700,592 | A | * | 5/1902 | Whiting | F41C 3/14 42/59 |
| 944,448 | A | * | 12/1909 | Lepever | F41A 19/31 42/19 |
| 2,835,171 | A | * | 5/1958 | Lyon | F41A 9/27 42/59 |
| 3,030,723 | A | * | 4/1962 | Ivy | F41A 19/52 42/59 |
| 3,051,057 | A | * | 8/1962 | Ivy | F41A 19/52 42/59 |

(Continued)

*Primary Examiner* — Jonathan C Weber

(74) *Attorney, Agent, or Firm* — Chris Tanner, Esq.; TannerPatent.com

(57) ABSTRACT

A firearm system having separate frame, action, & lock systems is disclosed. The firearm system is closed, sealed, and inaccessible when in safe mode. The physical gripping of the firearm allows access to a lock input component which is then physically actuated at which point if a lock code has been input correctly, the firearm system changes from safe mode to firing mode thereby allowing use as a firearm. Upon physical release of the grip, the firearm immediately returns to safe mode.

9 Claims, 27 Drawing Sheets

SIDE VIEW OF ACTION SAFE/AT REST POSITION

SIDE VIEW ACTION FULLY COCKED

(56) References Cited

U.S. PATENT DOCUMENTS

| | | | | | |
|---|---|---|---|---|---|
| 3,093,922 | A | * | 6/1963 | Ivy | F41A 17/26 42/59 |
| 3,163,951 | A | * | 1/1965 | Lewis | F41A 19/53 42/59 |
| 3,221,433 | A | * | 12/1965 | Lewis | F41A 19/53 42/62 |
| 3,729,853 | A | * | 5/1973 | Critcher | F41C 9/06 124/48 |
| 4,141,165 | A | * | 2/1979 | Dichter | F41C 3/14 42/59 |
| 4,316,339 | A | * | 2/1982 | Herriott | F41A 21/488 42/59 |
| 4,694,602 | A | * | 9/1987 | Pust | F41A 3/76 42/59 |
| 4,839,978 | A | * | 6/1989 | Lechelle | F41C 3/14 42/65 |

* cited by examiner

LEFT SIDE VIEW SAFE MODE

MUZZLE END VIEW SAFE MODE

GRIP END VIEW SAFE MODE

RIGHT SIDE VIEW SAFE MODE

LEFT SIDE VIEW FIRING MODE

MUZZLE END VIEW FIRING MODE

GRIP END VIEW FIRING MODE

RIGHT SIDE VIEW FIRING MODE

SIDE VIEW OF ACTION SAFE/AT REST POSITION

ISOMETRIC VIEW OF ACTION

EXPLODED VIEW OF ACTION

ISOMETRIC VIEW OF DRIVE DRUM 920

SIDE VIEW ACTION SAFE/AT REST POSITION

SIDE VIEW ACTION HALF COCKED

SIDE VIEW ACTION FULLY COCKED

SIDE VIEW OF ACTION FIRED POSITION

SIDE VIEW INTERIOR OF RIGHT SIDE SHELL 103

SIDE VIEW INTERIOR OF RIGHT SHELL 103/COUNTER

VIEW OF COUNTER AT ZERO

VIEW OF COUNTER RESETTING

VIEW OF COUNTER PAST 5 COUNTS

SIDE VIEW OF RIGHT SHELL103/INPUT

ISO VIEW OF INPUT 2201

SIDE VIEW RIGHT SHELL 103/SEQUENCER

ISO VIEW OF SEQUENCER

ISO VIEW OF SIDE OF SEQUENCER

VIEW OF SAFE SCREW 2701 AND SPECIAL DRIVER 2708

SAFE FIREARM SYSTEM AND METHOD

CROSS-REFERENCE TO RELATED APPLICATIONS

This application claims priority to U.S. Provisional application No. 61/870,260, filed on Aug. 27, 2013, the entire contents of which are hereby incorporated by reference.

BACKGROUND OF THE INVENTION

Firearms are generally intended for use solely by the owner/purchaser and other responsible individuals. However, unfortunately, many firearms intended for self-defense end up in the hands of criminals.

Another problem preventing children from gaining access to firearms. This can have tragic results. Consequently, an improved firearm system which, in the wrong hands is utterly useless as a weapon, is desired.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION OF THE PREFERRED EMBODIMENTS

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

The following detailed description will outline a firearm system, which may be described for the purpose of simplicity, as having a frame, action, & lock system. The detailed description and figures will show this firearm system as simply as possible by discussing the frame, the action, the lock, and then describing the entirety as a whole.

The firearm system described herein has a series of specific modes. The two most important modes of operation are safe mode & firing mode. A physical input sequence must be actuated on the firearm system to convert the system from safe mode to firing mode. This will be described in more detail later.

Figure 1:
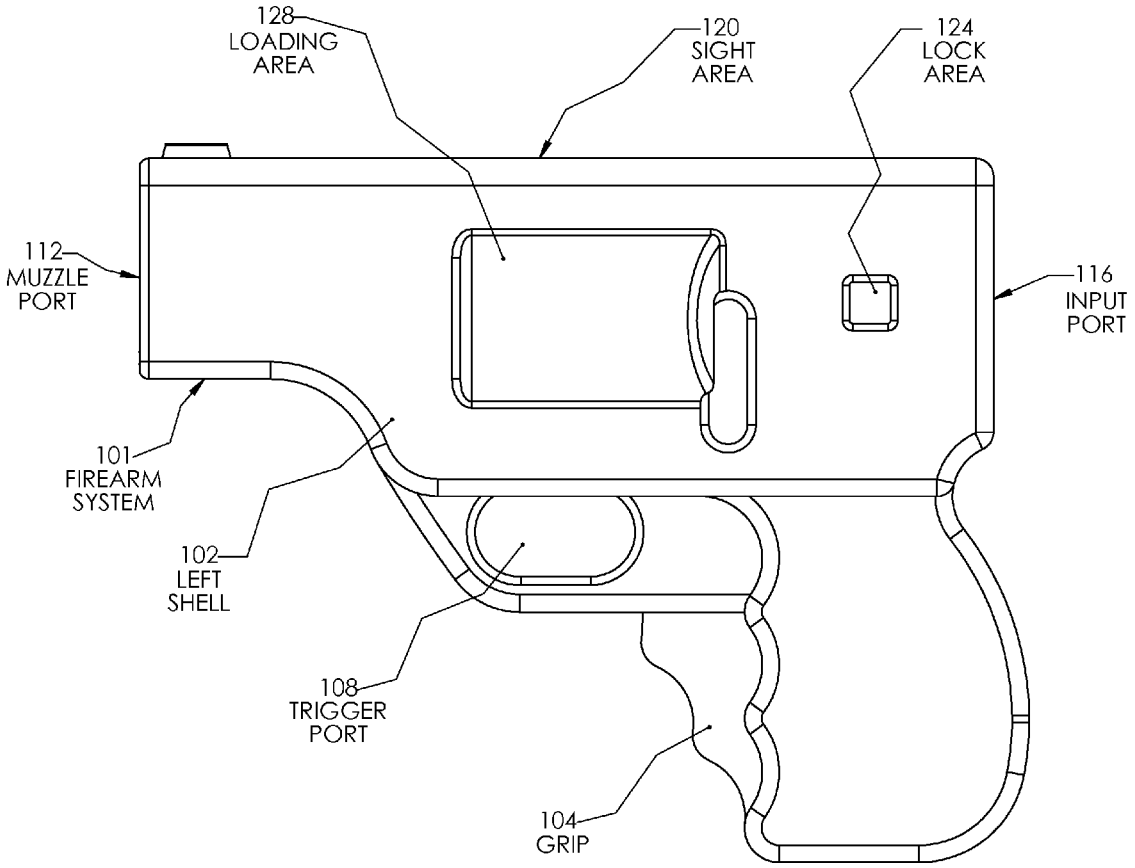
FIG. 1 depicts a left-side view of the assembled firearm system in safe mode.

FIG. 1 shows a left-side view of the firearm system 101, in a safe mode embodiment. The firearm system 101 in its entirety may be broken into two separate frame parts, the left shell 102 and the right shell 103. FIG. 1 also shows the relative positions of the grip 104, the trigger port 108, the muzzle port 112, and the input port 116. These are exterior moveable openings through the exterior of the assembled frame that allow codes to be input, triggers to be actuated, and the bullet to exit the interior of the frame for firing purposes.

Also shown in FIG. 1 are sight area 120, lock area 124, and loading port 128. From the view shown in FIG. 1, it is apparent that the firearm system 101 is stored, holstered, held, and ultimately fired similarly to most other pistol-type firearms. The grip 104 is held in the operating hand, and the sight area 120 is placed in position so that the firearm may be aimed. In firing mode, the firearm system 101 acts similarly to conventional firearms.

As stated, FIG. 1 shows the firearm system 101 in safe mode, including the muzzle port 112, the input port 116, and the closed trigger port 108. The grip 104 is also shown extended in its outer most position. The grip 104 is the physical actuating mechanical lever that assists in changing the firearm system 101 from safe mode to firing mode.

Figure 2:
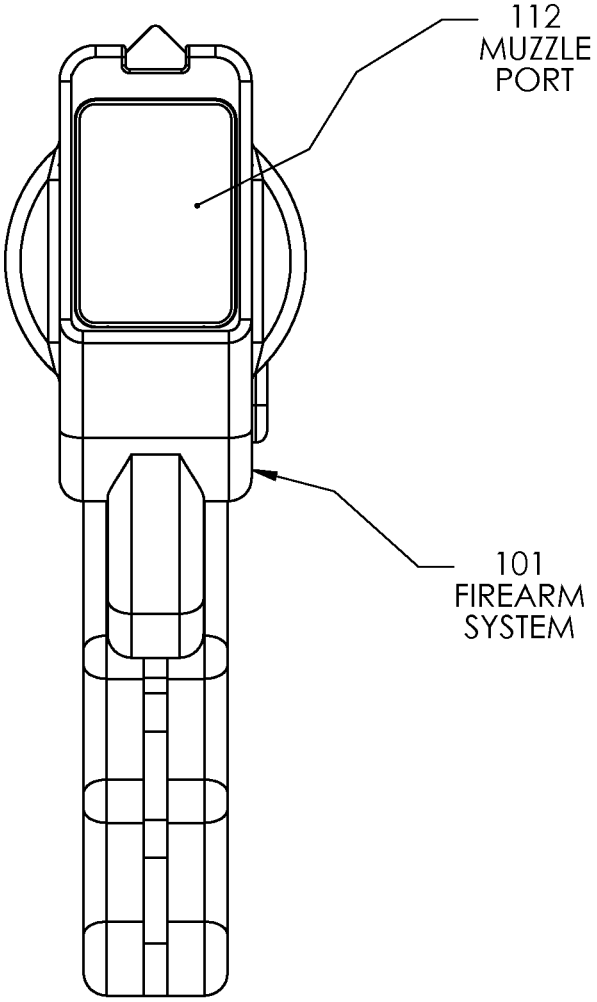
FIG. 2 depicts a view of the muzzle end in safe mode.

FIG. 2 shows the muzzle (end) port 112 of the firearm system 101 in safe mode. The muzzle is completely blocked by the muzzle port 112, which is capable of completely closing this opening in a water resistant and tamper resistant fashion.

Figure 3:
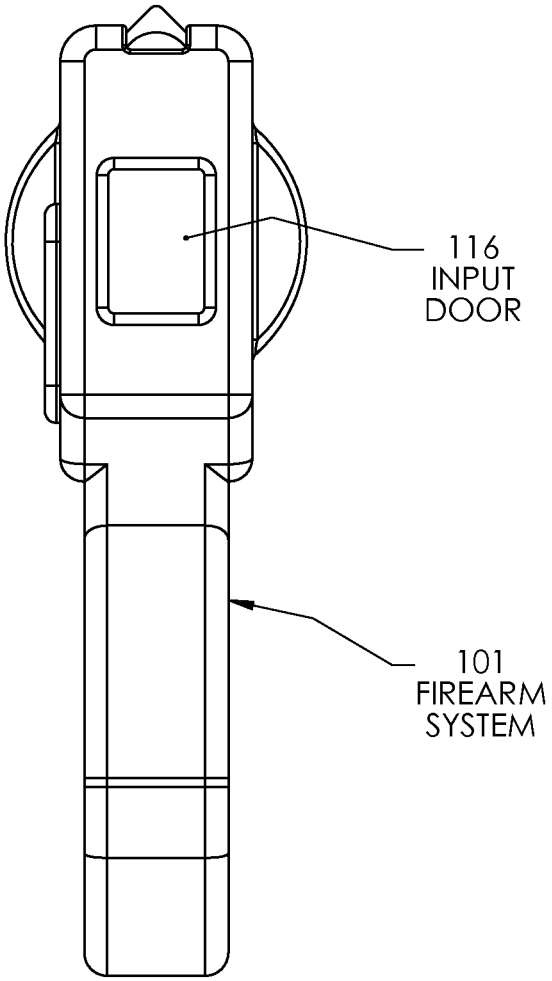
FIG. 3 depicts a grip end view of the firearm in safe mode.

FIG. 3 shows the grip 104 in safe mode, in which the input port 116 is in a closed position thereby making it impossible to input a code into the firearm system 101.

Figure 4:
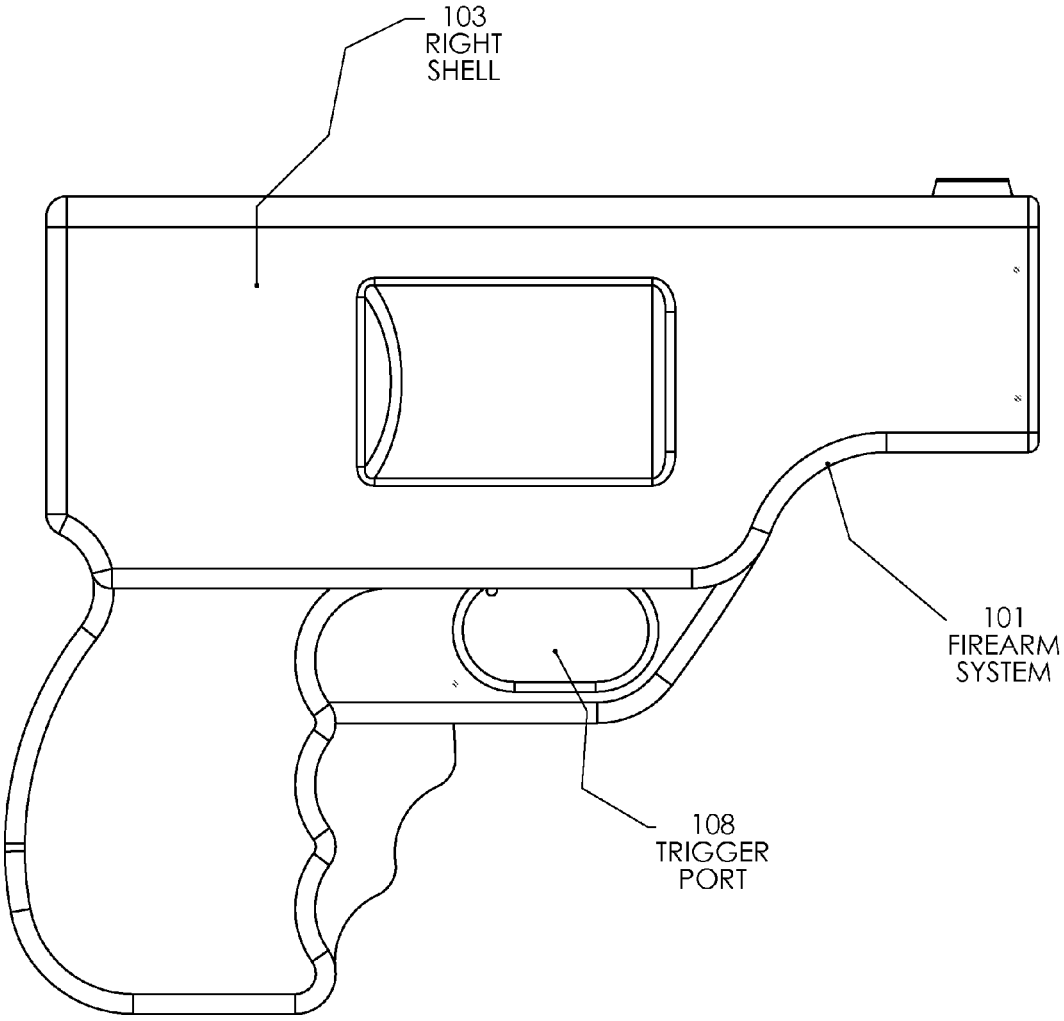
FIG. 4 depicts a right-side view of the firearm in safe mode.

FIG. 4 shows a right-side view of the firearm system 101 in safe mode. FIG. 4 shows an opposite view of right shell 103. The left shell 102 and right shell 103 form the two exterior halves of the firearm system 101 and are designed specifically to be held together by a series of safety related tamper proof screws which provide the framework, which if disassembled, render the firearm system 101 inoperable. FIG. 4 also shows the trigger port 108, which, due to design, is closed in the safe mode on this opposite side also, thereby preventing access to the trigger or interior of the firearm system 101 when in safe mode.

The various exterior moveable ports of the firearm system 101 are designed primarily as a safety feature to minimize the potential of anyone accessing the interior of the firearm when it is in safe mode. An additional purpose for making these moveable ports water and tamper resistant is that during storage there is no opportunity for water, dust, or other environmental elements to infiltrate the firearm system 101, any of which could cause a malfunction of the firearm system 101.

During safe mode, the closed exterior of the firearm system 101, is readily identifiable as being in safe mode by virtue of the trigger and muzzle not being exposed.

The transition from safe mode to firing mode will be described in greater detail later when the action and the lock system are described, but a brief description is required at this point in order to describe the transition from safe mode to firing mode. The transition between safe mode and firing mode is visible in the changes which occur between steps 1-5 (below).

(1) The firearm system 101 is held in the operating hand.

(2) A light to medium pressure is exerted on the grip 104 for the purpose of allowing the grip 104 to mechanically lower the input port 116, which allows access to the lock system.

(3) The thumb of the operating hand inputs a code on the keys of the lock 124 thereby allowing the lock mechanism to shift from locked to unlocked position.

(4) With the correct code thus properly input, the grip 104 will then move completely into the handle of the firearm system 101 via a predetermined travel path, at which time the mechanical linkages will open the muzzle port 112 and the trigger port 108.

(5) At this point, the firearm system 101 has been moved from safe mode to firing mode. In firing mode, the finger of the operating hand may reach through the trigger port 108 accessing the trigger for the purpose of firing the firearm system 101 as a double action revolver or semi-automatic firearm depending on which action has been integrally built into the firearm system 101. A double-action revolver embodiment, as well as a semi-automatic embodiment, are both disclosed and enabled herein.

(6) Upon completion of firing there is an opportunity to access a mechanical loading port 124 for the purpose of reloading.

(7) After firing, and as soon as the operating hand releases the spring return, action of the grip 104 of the firearm system 101 and all of its ports: trigger port 108, muzzle port 112, input port 116, and loading port 128, the system 101 returns to safe mode. The muzzle port 116 closes, the trigger port 108 closes, and the input port 116 closes, resulting in complete resetting of the firearm system. 101. There are access ports available during firing mode, which allow the code to be changed. The mechanical system that changes the firearm system 101 from safe to firing mode also literally disables the ability of the action to function so that the firearm system 101 cannot be made to fire while in safe mode.

Figure 5:
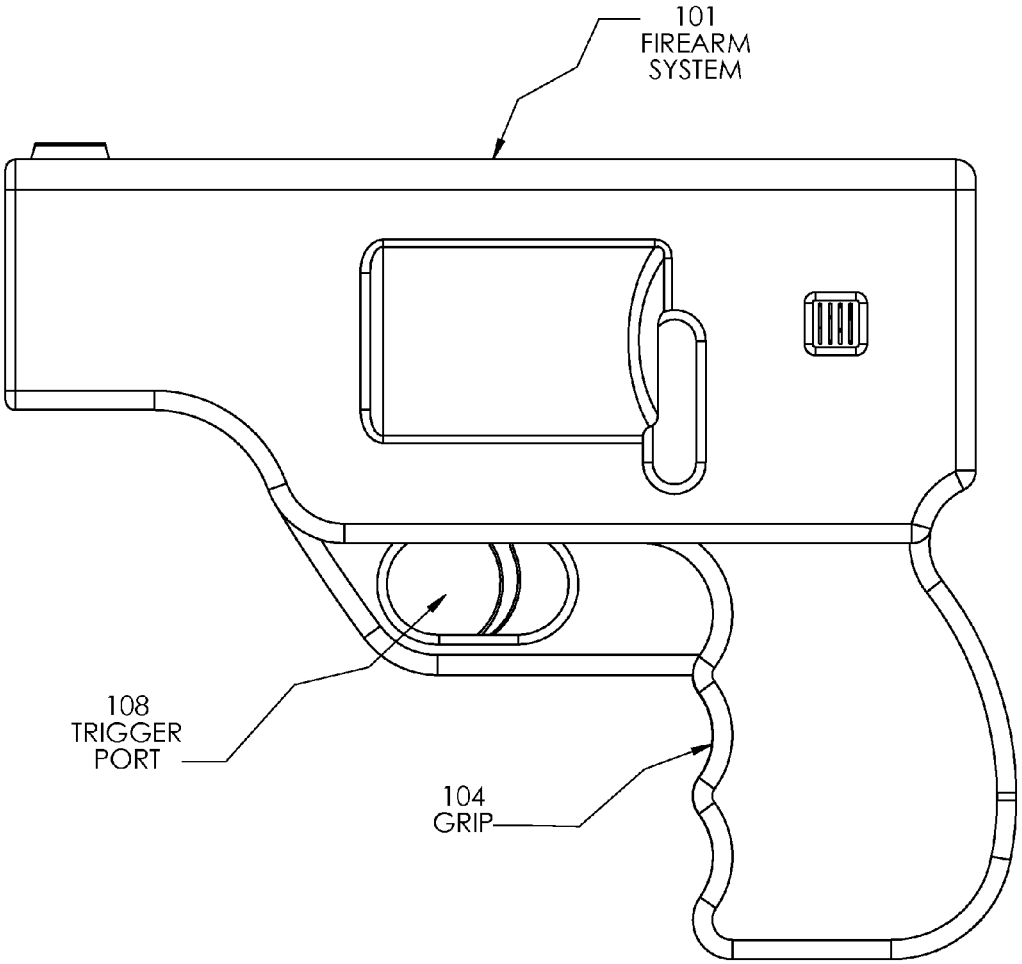
FIG. 5 depicts a left-side view of the firearm in firing mode.

FIG. 5 shows the firearm system 101 in a left-side view in firing mode. In FIG. 5, the grip 104 has been depressed completely into the handle. The trigger port 108 is open thereby exposing the trigger and allowing access for a finger to reach through and activate the trigger.

Figure 6:
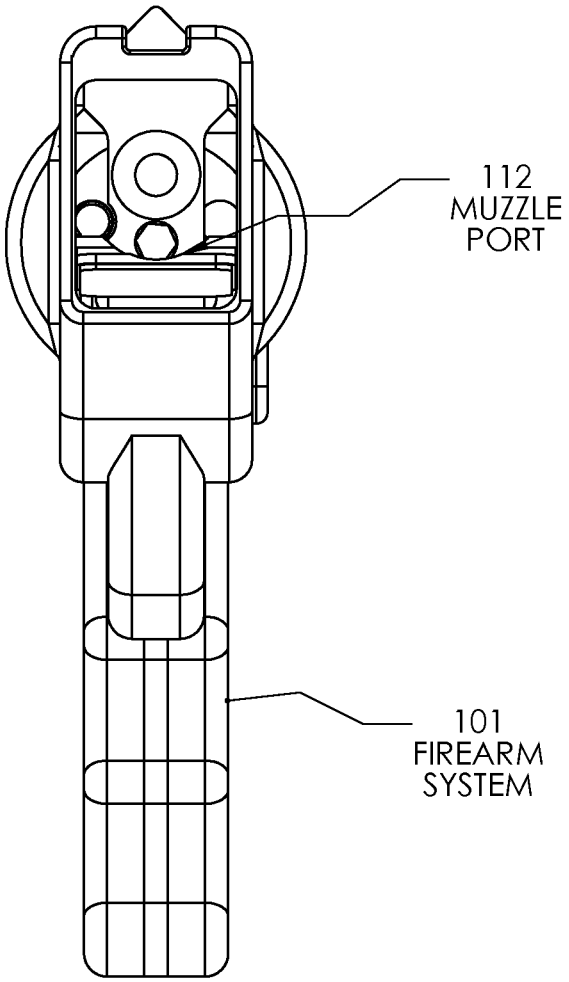
FIG. 6 depicts a muzzle end view of the firearm in firing mode.

FIG. 6 shows a muzzle view in firing mode. In FIG. 6, the muzzle port 112 has been mechanically retracted into its resting area thereby exposing the muzzle of the firearm system 101. This will allow a bullet to exit the interior of the firearm system 101 through the muzzle port 112.

Figure 7:
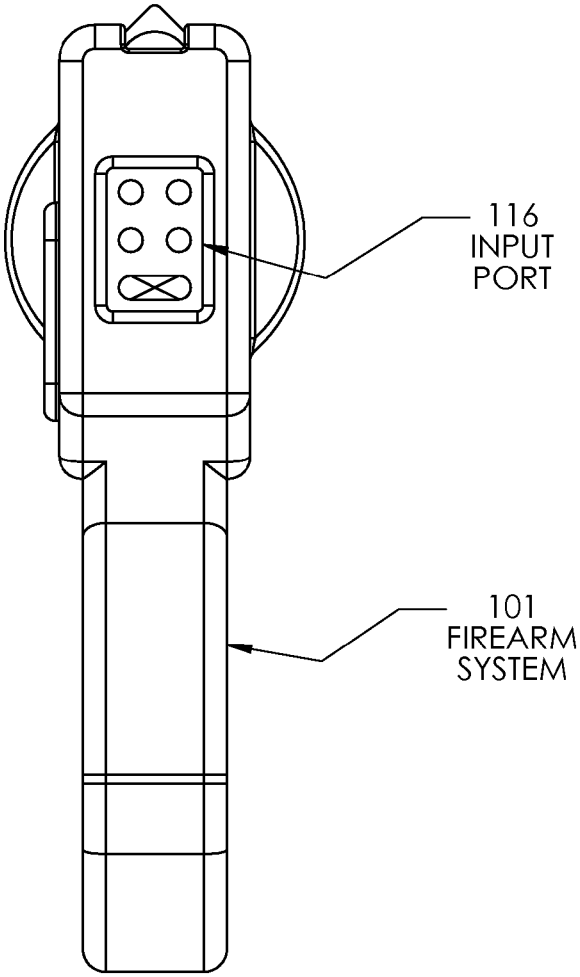
FIG. 7 depicts a grip end view of the firearm in firing mode.

FIG. 7 shows the grip 104 view during firing mode, In FIG. 7, the input port 116 is open, so as to enable access to the input keys.

Figure 8:
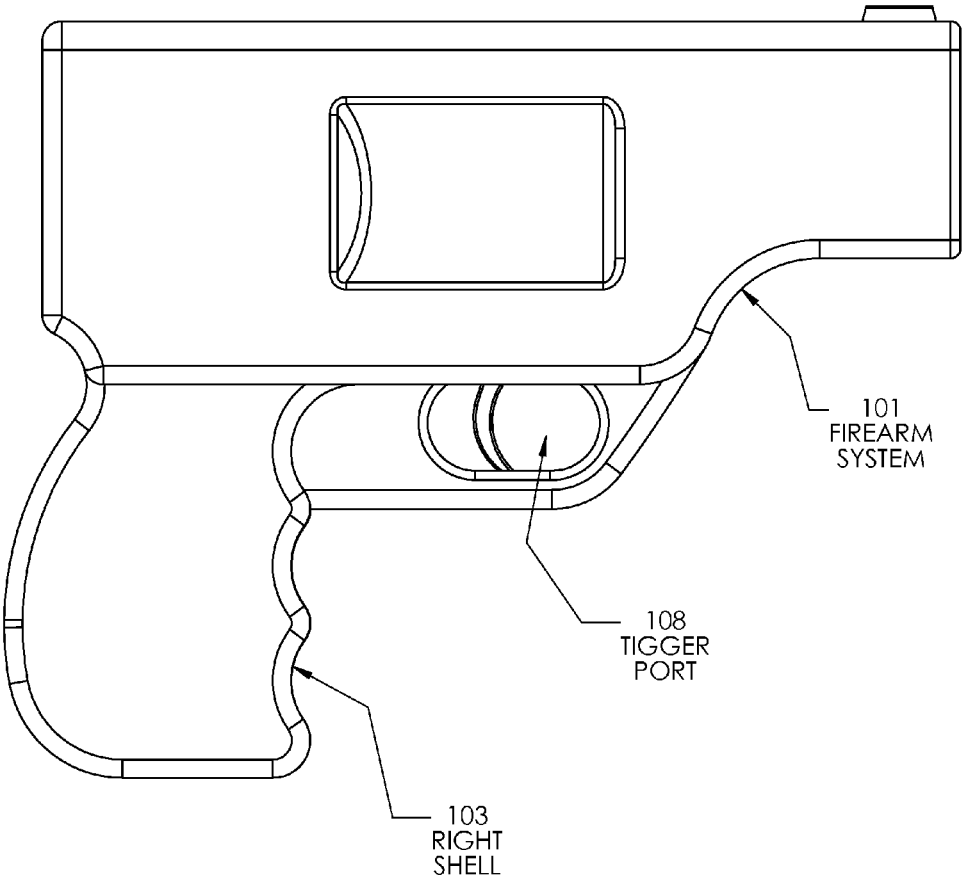
FIG. 8 depicts a right side view of the firearm in firing mode.

FIG. 8 shows the right-side view of the firearm system 101 in firing mode. The right shell 103 is shown in this view. The trigger port 108 is shown in its open position, allowing access of the operating finger.

For purposes of clarity it should be understood that there is a period of access available between the two distinct modes of the firearm system 101. This will be discussed in more detail later in a discussion of how the lock and the action interact with each other.

It should now be easier to understand that when the firearm system 101 is in safe mode, it is closed, sealed, and extremely safe. The physical gripping of the firearm system 101 allows access to a lock input component which is then physically actuated at which point if the lock code has been input correctly, as the pressure applied to the grip 104 changes, the firearm system 104 transitions from safe mode to firing mode thereby allowing use of the firearm system 101 as a firearm. Upon physical release of the grip 104 the firearm system 101 returns immediately to safe mode.

It should also be understood that at the heart of the embodiments disclosed herein, each system, the frame, action, and lock are designed in such a way that tampering or attempting to overcome the safety features will cause the firearm system 101 to be rendered inoperable and unable to discharge a round of ammunition.

The firearm system 101 is broken into three broad components, which are the frame, action, and the lock.

The action of the firearm system 101 has two main functions, the first of which is the production of a firearm system action that cannot be separated from the firearm system 101 to be used as a standalone firearm. The second important function is the manner in which the components are designed and are held into place by the frame is at the heart of the firearm system 101. The function of the action's design is that, due to the simplicity of design and components it can spend most of its service life in storage and can still be expected to operate correctly with a minimal amount of routine maintenance.

It should also be easily understood that conventional firearms due to their large number of moving parts and close tolerances do not tolerate dirt or other debris, which might penetrate the action. The firearm system 101 is designed so that the loading and cylinder areas are capable of being cleaned but the actual hammer and firing component areas are concealed in such a way as to resist dust, moisture, etc. while in storage so that they can be expected to operate correctly with a good service life.

Figure 9:
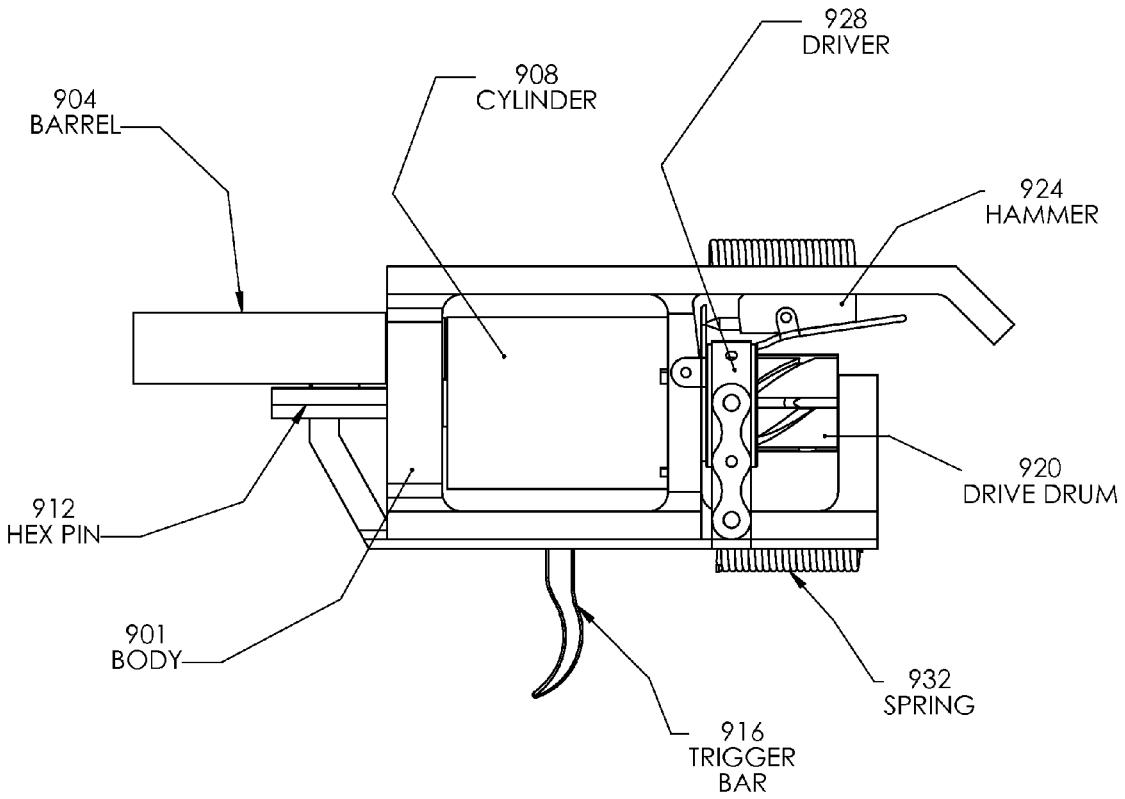
FIG. 9 shows a body which holds in position various components of the action as well as the support mechanisms.

FIG. 9 shows a body 901 which is designed to hold in position the various components of the action as well as the support mechanisms provided by the exterior described earlier. As shown in FIG. 9, the body 901 has on its left portion a barrel 904 either threaded or welded into position for the purpose of guaranteeing a connection that will withstand the pressures which are produced by gunpowder detonation.

FIG. 9 also shows that body 901 has at its center a cylinder 908 which has a hexagon shaped opening at its center which allows the hex pin 912 to penetrate one side of body 901, then penetrate cylinder 908, continue its penetration through the frame, and ultimately penetrate the hex shaped portion in drive drum 920 for the purpose of mechanically locking the firearm system 101.

The ability to lock the cylinder 908 and drum drive 920 into a rotary timing by hex pin 912 allows that linear input provide by driver 928 and trigger bar 916 can rotate the drive drum 920 for the purpose of transferring, very accurately, a rotary force to cylinder 908. The rotary motion supplied by trigger bar 916 is ultimately transferred to cylinder 908 for the purpose of revolving cylinder 908 so that the next round of ammunition may be fired.

Also shown in FIG. 9 is a hammer 924 in its position inside body 901. The hammer 924 is designed so that linear motion provided by trigger bar 916 may be transferred to it for the purpose of pulling it back against spring resistance produced by spring 932. Resistance produced by spring 932 can be released by a moving portion of the hammer 924 thereby allowing it to slide forward with force and velocity for the purpose of striking the primer on a cartridge, thereby firing the round of ammunition.

The components described in FIG. 9 will be described in more detail but it is important to understand that linear trigger pressure on trigger bar 916 can be transferred to the drive drum 920 thereby rotating the cylinder 908. The same pressure applied to trigger bar 916 can be transferred ultimately to hammer 924, by pulling it back and releasing it for the purpose of firing the round of ammunition.

Figure 10:
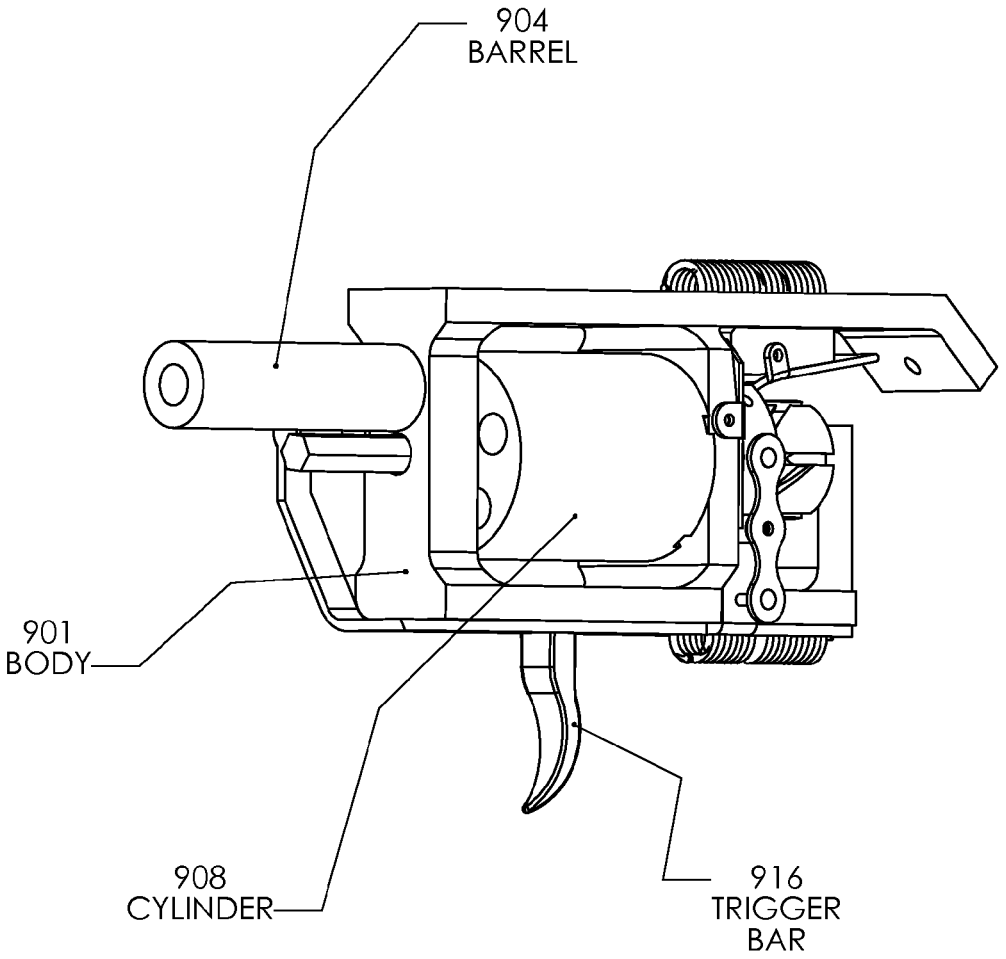
FIG. 10 shows an isometric view of the body and the corresponding position of the barrel.

FIG. 10 shows an isometric view of the body 901 and the corresponding position of barrel 904, which provide an exit for a round of ammunition, as is commonly understood in relationship to conventional firearms. Cylinder 908 is held into the cavity of body 901 by a hex shaped pin thereby allowing it rotate about its axis as commonly understood with a conventional revolver-style firearm.

Trigger bar 916 as shown in FIG. 10 is also shown capable of moving linearly by pressure applied by a finger for the purpose of not only rotating cylinder 908 but also applying the necessary force to pull back and fire the firearm system 101 in a manner which is understood in relationship to a conventional firearm.

Figure 11:
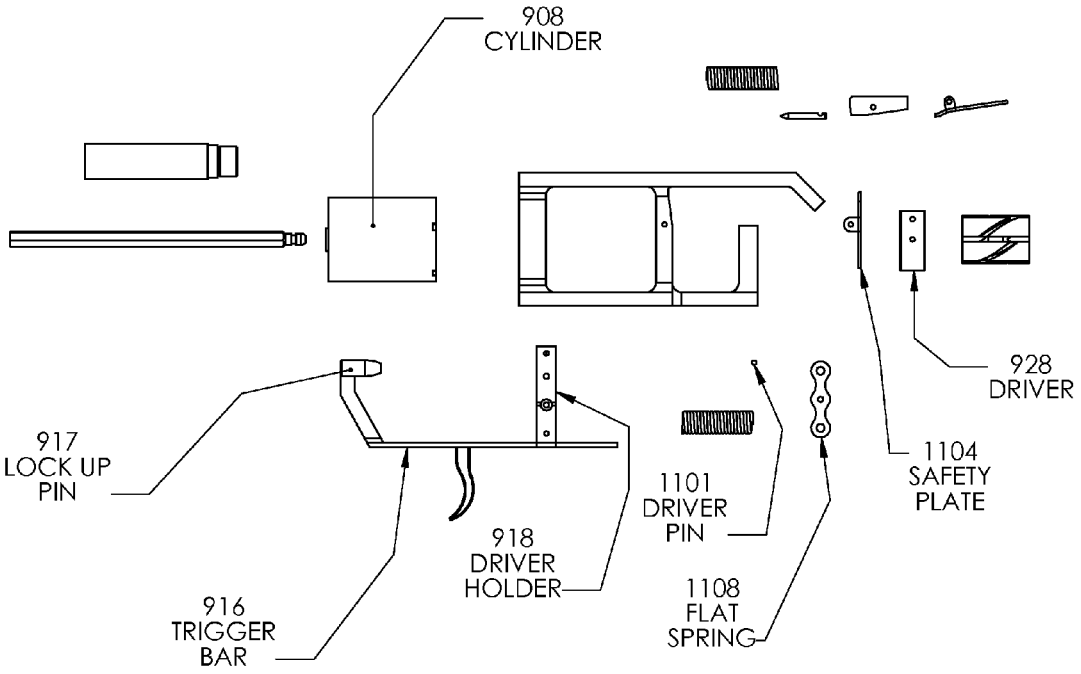
FIG. 11 shows an exploded view of the action and also to provide an expanded explanation of the trigger bar.

FIG. 11 shows an exploded view of the action for the purpose of defining some smaller important parts and also to provide an expanded explanation of trigger bar 916. FIG. 11 shows driver 928 in exploded relationship to the other components of the action. Driver 928 has contained in one side of it the driver pin 1101, which is held into place by flat spring 1108.

It should be understood that by placing driver 928 in a fixed position inside trigger bar 916, linear force is transferred from trigger bar 916 to driver 928 which then moves linearly thereby taking with it driver pin 1101. This movement transfers its force to the rotary components of the action.

Flat spring 1108 provides a downward but floating pressure that will be described later in relationship to the actions of driver pin 1101.

FIG. 11 also shows lock up pin 917 which is designed so that as the trigger bar 916 travels linearly, the lock up pin 917 locates and locks into position by entering one of the ammunition holes in the cylinder 908 for the purpose of locking and indexing the cylinder 908 when firing. The lock up pin 917 is connected to a driver holder 918.

FIG. 11 also shows safety plate 1104 and its relationship to driver 928 and the frame in an exploded view. The safety plate 1104 is designed to eliminate the ability for the hammer 924, shown in other views, to never impact the primer on a round of ammunition and fire it due to inertial force from an accidental drop or striking of the firearm system 101. The safety plate 1104 moves about a pivot and physically restrains the hammer 924 during safe mode for the purpose of preventing movement of the hammer 924 from moving forward in safe mode, preventing it from touching a primer unless driver 928 has been moved rearward by linear force from trigger bar 916.

Figure 12:
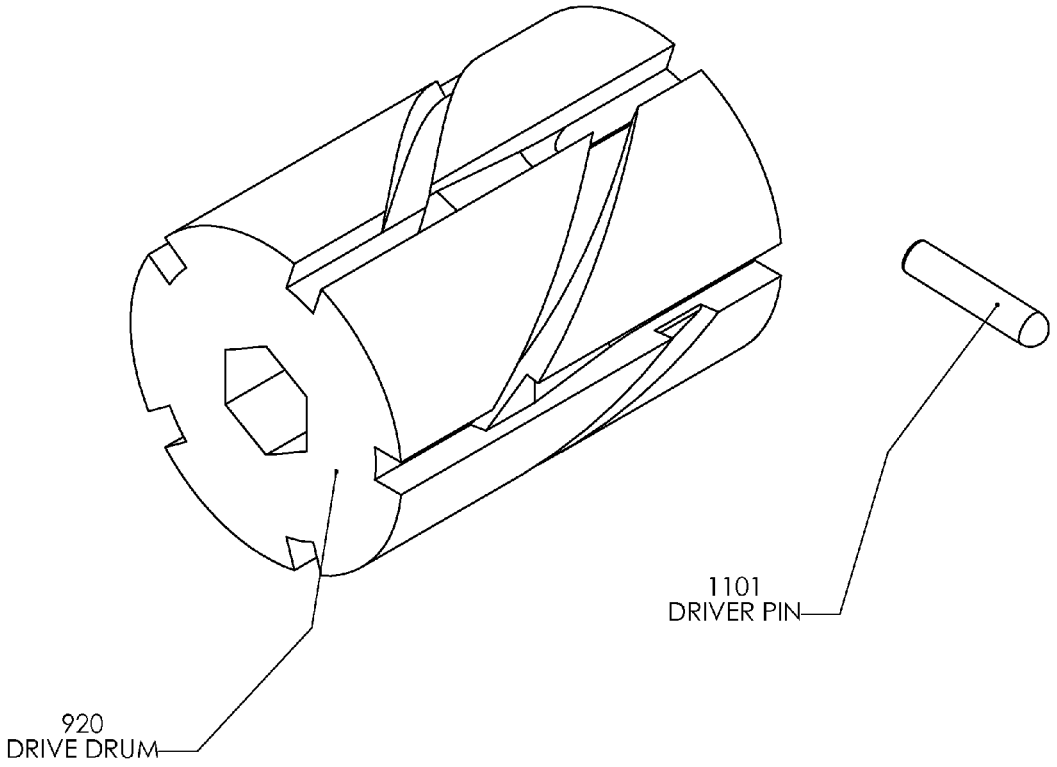
FIG. 12 shows an isometric view of drive drum and driver pin.

FIG. 12 shows an isometric view of drive drum 920 and driver pin 1101. It is important to show that the feature and drive drum 920 is integral to the operation and function of the action. The drive drum 920 has a series of grooves on its exterior that are shaped to allow linear input from driver pin 1101 to rotate the drive drum 920 in such a way as to align the holes in the cylinder 908 appropriately with the body 901.

The grooves in drive drum 920 are designed as a series of ramps and slots that allow the driver pin 1101 by moving linearly to only produce drive in one direction preventing the drive drum 920 from rotating in the opposite direction in any circumstances. The firearm system 101 action simplifies many of the moving components in a conventional revolver while allowing drum drive 920 to perform the same function.

As shown in FIG. 12, the driver pin 1101 is held into position in one of the slots. When it is moved linearly, due to the change in height from the slot it just came out of, it is forced into a slot which has a slow but gradual ramping surface on it so that as it rotates the cylinder 908 when the driver pin 1101 has reached its end ramp, dropped in to the new slot, and dropped slightly rearward it is at that time all of the components of the action have been put into position to fire; at that point it will allow the hammer 924 to fall, thereby firing the round of ammunition.

Due to spring tension from spring 932 the driver pin 1101 will travel completely back through groove to rest in safe position until linear movement on trigger bar 916, not shown, moves rearward again. The change in contour of the grooves in drive drum 920 provide a series of mechanical movements that provide that only one round at a time may be fired and only may be fired if trigger bar 916 moves completely through the length of its travel path.

Figure 13:
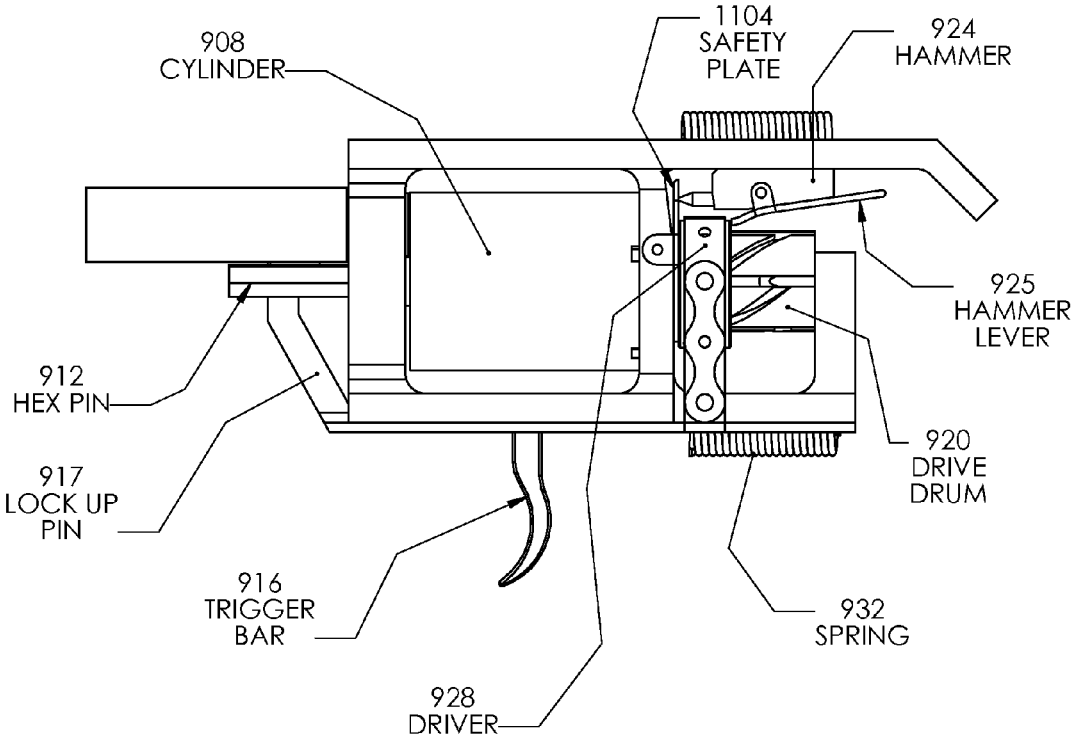
FIG. 13 shows a side view of the action in safe or at rest position.

FIG. 13 shows a side view of the action in safe or at rest position. It can be seen from the previous explanations that various components are labeled in relationship to FIGS. 13-16 show the series of movements that are required, and the change in location of the various components that affect a change from safe to fired position on the action.

FIG. 13 shows that the driver 928 is in, toward the cylinder 908, the hammer 924 is located in its at rest position, safety plate 1104 is in a perpendicular position with the driver 928, hammer lever 925 is located in position behind driver 928, trigger bar 916 is in its furthest movement forward toward the barrel end of the body 901, and lock up pin 917 is shown extended out and not entered into the cylinder 908 on the opposite side of this view. This describes the action in an at rest position.

In this position the ammunition stored in the cylinder 908 is unable to be fired. The nature of the firearm provides that in the safe or at rest position the primer for the round of ammunition in the cylinder 908 is visible and in line with the hammer 924. However, the ability for the hammer 924 to strike this under impetus of being dropped or violently struck is impossible due to the interference from safety plate 1104. Therefore, the rounds of ammunition held on the interior of the cylinder 908 are as safely stored to the extent possible.

Figure 14:
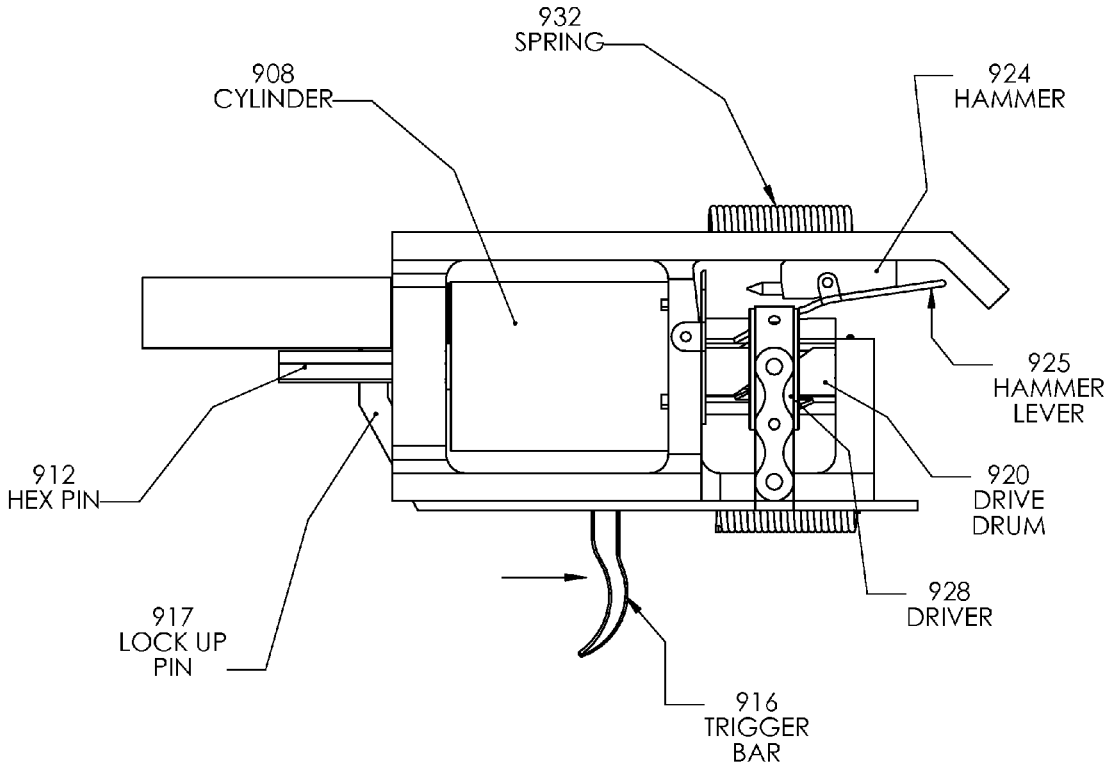
FIG. 14 shows the same view with the components in a half-cocked position.

FIG. 14 shows the same view with the components in a half-cocked position. As shown by the arrow, the trigger bar 916 has been moved approximately halfway through its travel rearward.

Trigger bar 916 has moved rearward carrying with it driver 928. The drive drum 920 is shown rotated slightly due to the effect of driver 928. The driver 928 is shown carrying rearward with it hammer 924 and ultimately hammer lever 925 which is headed toward a portion of the body 901 angled to trip lever 925 as it moves back to full position. Spring 932 is shown being stretched or compressed, according to its design, for the purpose of providing a return motion for hammer 924 and also a reset motion for the entire trigger bar 916.

It is shown in FIG. 14 that lock up pin 917 has moved rearward and prepared to enter cylinder 908 at the end of its travel for the purpose of locking the entire cylinder 908 into position during detonation of the round of ammunition.

Figure 15:
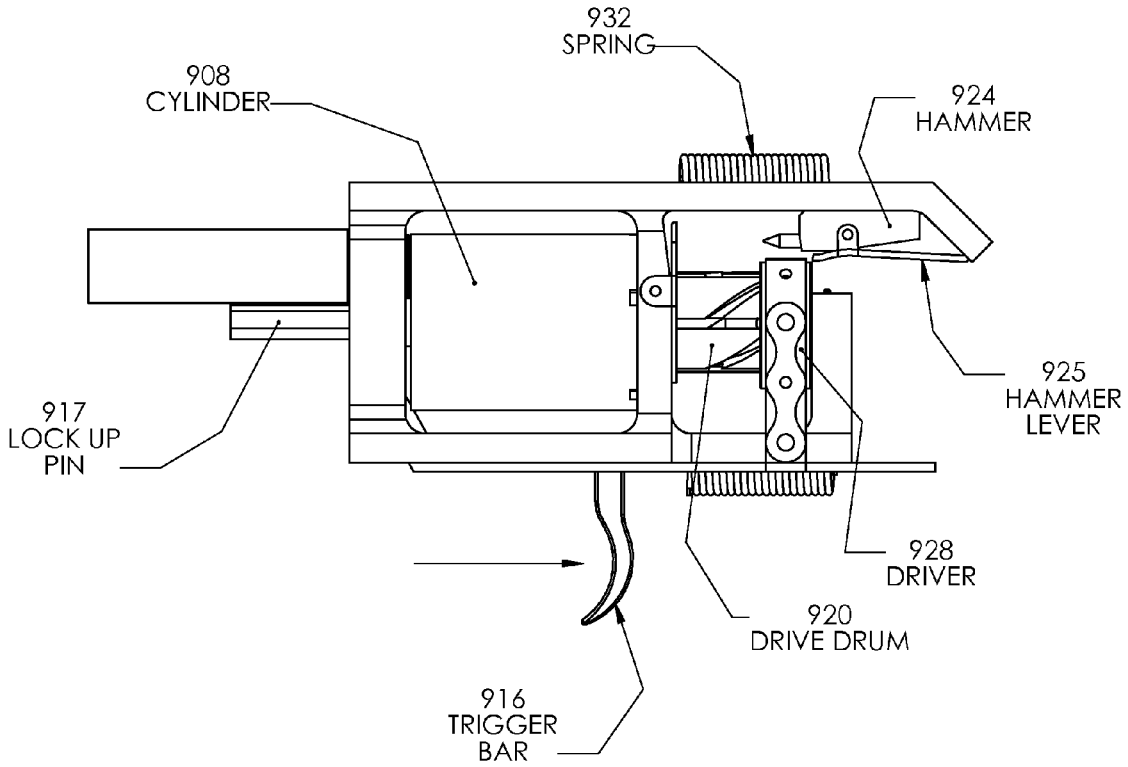
FIG. 15 shows a side view of the action fully cocked.

FIG. 15 shows a side view of the action fully cocked. The trigger bar 916 has moved to the furthest most rear position. The embodiment as shown in FIG. 15 is at approximately 99% fully cocked position. The trigger bar 916 when moving rearward will come to its farthest most rear position at approximately same time that hammer lever 925 is pushed downward by a portion of the body 901. This action rises above its holding area lever 925 and allows hammer 924 to fall forward, thereby detonating the round of ammunition.

Lock up pin 917 has fully entered cylinder 908 and locked it up thereby providing a stable and secure holding position.

Figure 16:
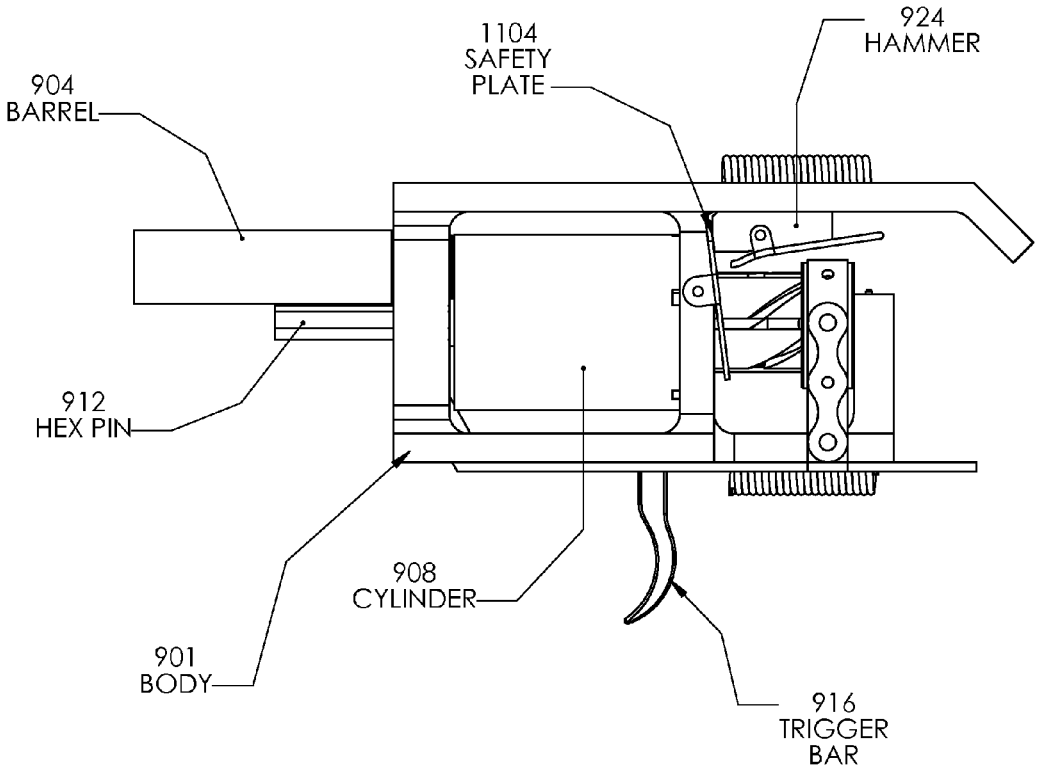
FIG. 16 shows a side view of the action in the fired position.

FIG. 16 shows a side view of the action in the fired position. It is shown that the primary difference between fully cocked and fired position is that hammer 924 has travelled forward thereby moving to an angle hinged safety plate 1104 which allows the hammer 924 to strike the primer of the cartridge. This fires the round of ammunition on the interior of the cylinder 908 and allowing it to exit barrel 904 for the purpose of firing the firearm system 101.

It should now be apparent that at the end of fired position, due to the spring pressure described earlier, the trigger bar 916 is released and the action will immediately return to the safe or at rest position described earlier in FIG. 13.

This sequence of the action system is designed so that by pulling rearward on the trigger bar 916 the operator is capable of tiring one round. After such a firing, the trigger bar 916 must come fully forward for the purpose of returning into position and then be pulled back again thereby affecting another firing sequence.

If the trigger is only pulled back, for example, at 95% of its travel and then released, the action system will then rotate back to the previously held safe at rest position until the trigger bar 916 has been pulled back completely through its range of motion for the purpose of carrying hammer 924 rearward and rotating the cylinder 908 into position to produce a successful firing sequence.

It is important to state that the movement of the action is determined by the ability for the trigger bar 916 to move linearly. The frame, during assembly, has the action components placed in their correct relationship to it as described earlier. Then ultimately. during assembly, the lock portion, yet to be described, is put in place. At the heart of the lock embodiment portion is a mechanical stop that prevents trigger bar 916 from moving through its entire range of motion for a firing sequence unless the lock mechanism has been placed so that the mechanical stop allows the trigger bar 916 to bypass it. This is at the heart of how the lock mechanism keeps the action of the firearm system 101 from functioning unless the lock system has been placed in the correct position for the trigger bar 916 to bypass it.

Figure 17:
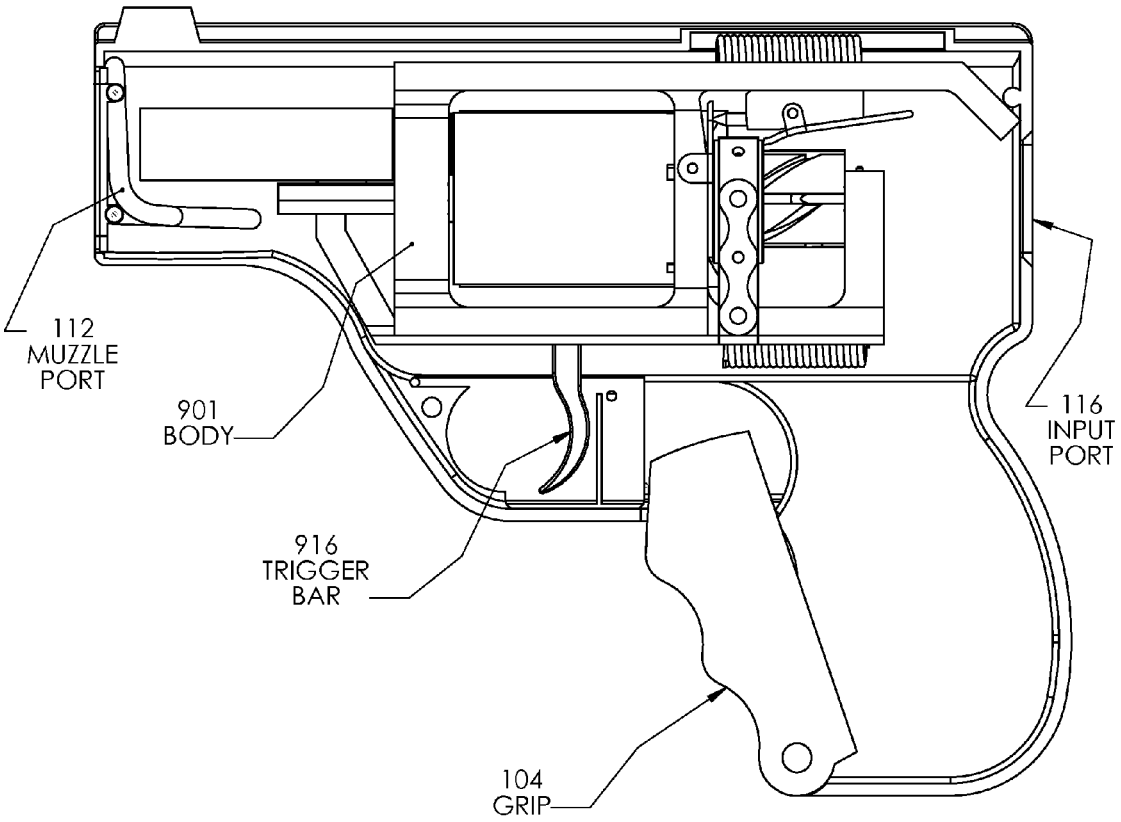
FIG. 17 shows a side view of the interior of right shell.

FIG. 17 shows a side view of the interior of right shell 103. For clarity, it should be understood that the shells, right shell 103 and left shell 102, have been separated and FIG. 17 is an interior view of the right shell 103.

FIG. 17 shows the position of the body 901 and the corresponding components of the action, placed into right shell 103 for the purpose of assembly.

Also shown in FIG. 17 is the interior of right shell 103 which has a series of areas that contain portions of the body 901 and the other portions of the action, including trigger bar 916 holding them in such a way as to place them in operating positions while they are on the interior of right shell 103.

In FIG. 17, the muzzle port 112 is shown in safe position, as is the grip 104. Toward the rear of right shell 103 an input port 116 is shown as well as the area on the interior of right shell 103 where the lock components will fit and function.

Figure 18:
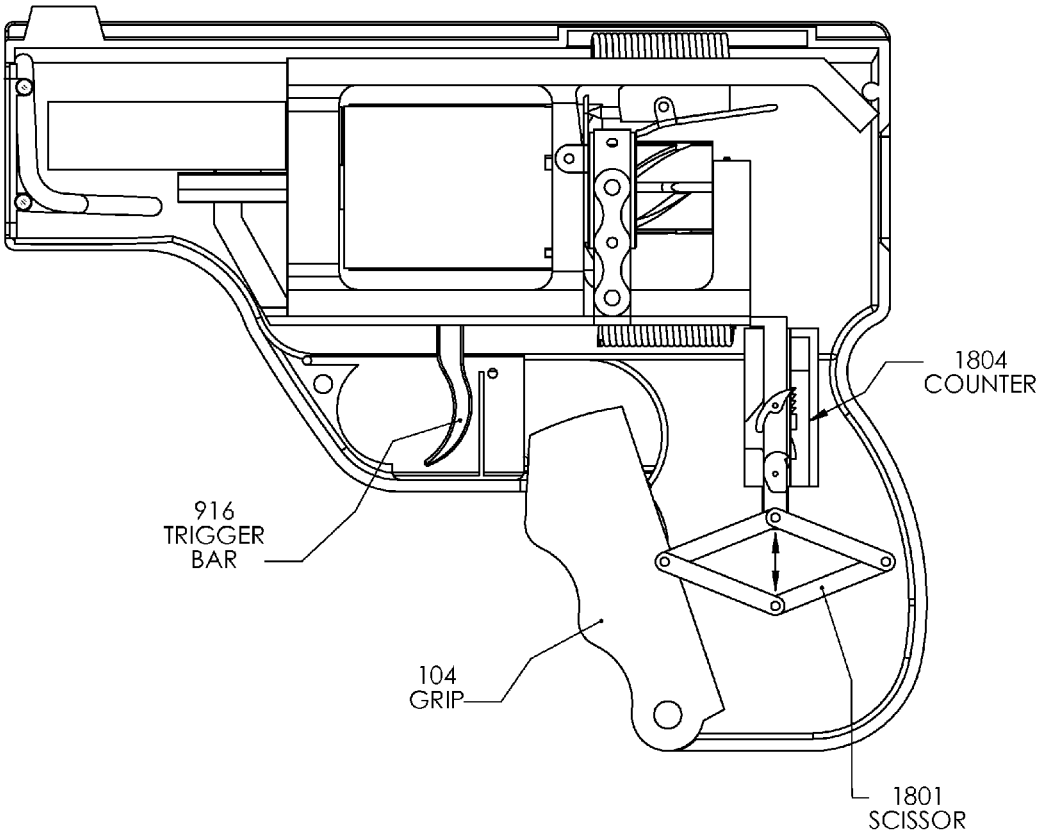
FIG. 18 shows a side view of the interior of the right shell with various other components.

FIG. 18 shows a side view of the interior of the right shell 103 with the addition of various components. FIG. 18 shows right shell 103 with the addition of scissor 1801 which is a simple mechanical scissor movement which allows that the pressing inward of grip 104 will allow a change of horizontal to vertical movement applied to counter 1804. The counter 1804 is designed to mechanically count the number of correct lock sequence attempts. It is shown that trigger bar 916 on its back edge, is physically blocked from moving rearward by counter 1804.

In simple terms, the grip 104 is depressed inward, providing a change in direction action on scissor 1801, which provides a linear physical action on counter 1804 for the purpose of raising and lowering of parts of counter 1804. It should be understood that scissor 1801 and grip 104 have corresponding spring-type mechanisms, which return them to their starting position at the completion of each cycle.

Figure 19:
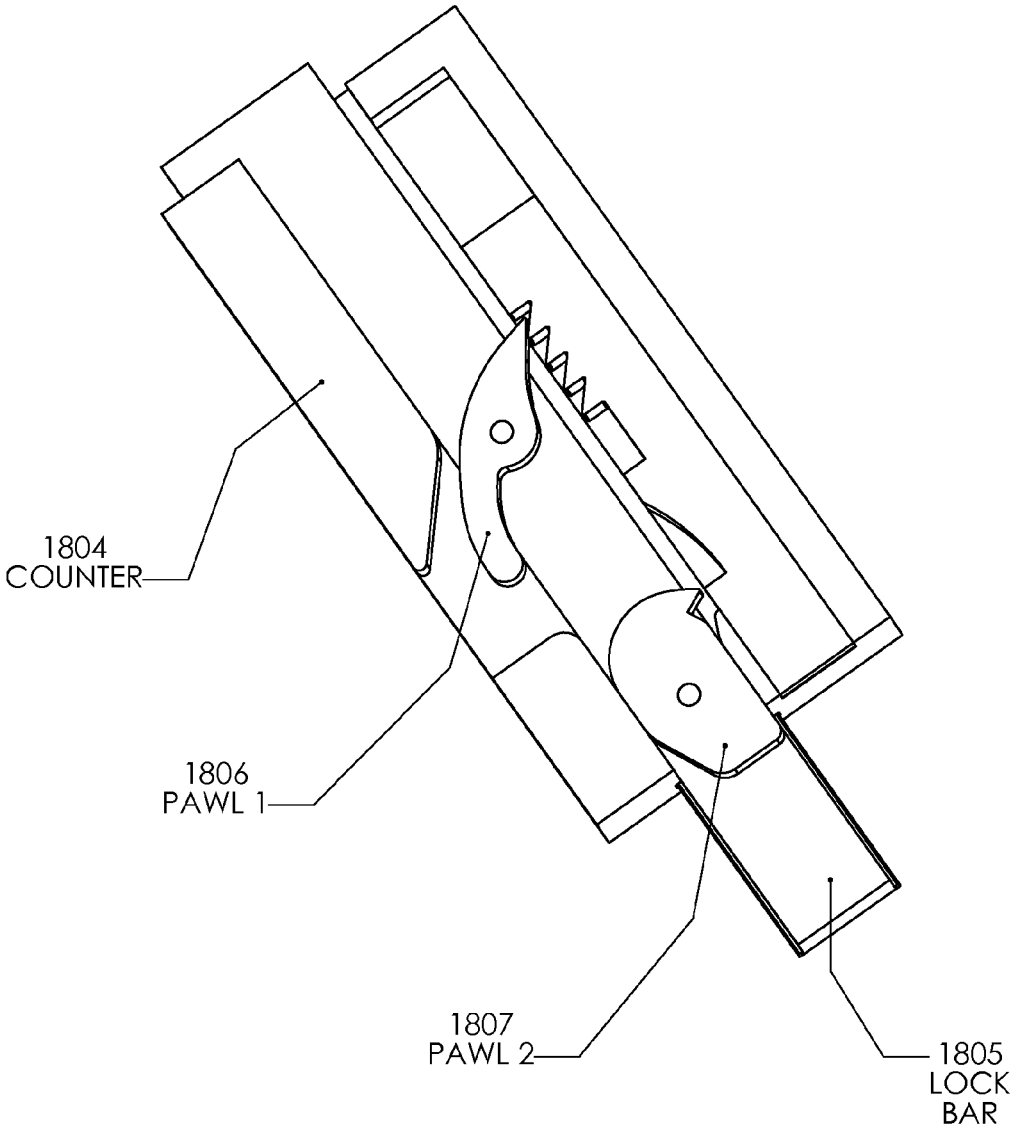
FIG. 19 explains the interior workings of the counter.

FIG. 19 explains the interior workings of counter 1804, which has secured internally in it the lock bar 1805, yet is still capable of linear movement. This lock bar 1805 carries on its upper surface, pawl one 1806 and pawl two 1807.

The interior compartment of counter 1804 contains a series of ridges and notches which allow movement applied to lock bar 1805 to move at two different distances, depending upon the distance of travel applied to lock bar 1805.

Counter 1804 is designed so that a short travel distance moves pawl one 1806 up a short distance, thereby allowing it to count each time lock bar 1805 receives linear movement.

Counter 1804 also has included pawl two 1807, that is designed to allow the lock bar 1805 to be returned or reset to the zero counting position if a lock sequence is input correctly.

In simple terms, a short travel sequence applied to lock bar 1805 by scissor 1801 allows pawl one 1806 to travel upward a short distance and return for the purpose of catching another notch in the side of counter 1804 during a short travel sequence.

During a long travel sequence, the lock bar 1805 travels far enough that pawl one 1806 is pushed out physically, allowing lock bar 1805 to travel upward in a long travel sequence. This allows interaction with components which are above it so that at the end of a long travel sequence pawl two 1807 may capture a contour in the counter 1804 for the purpose of moving it rearward, and thereby allowing a resetting of the entire sequence.

Figure 20:
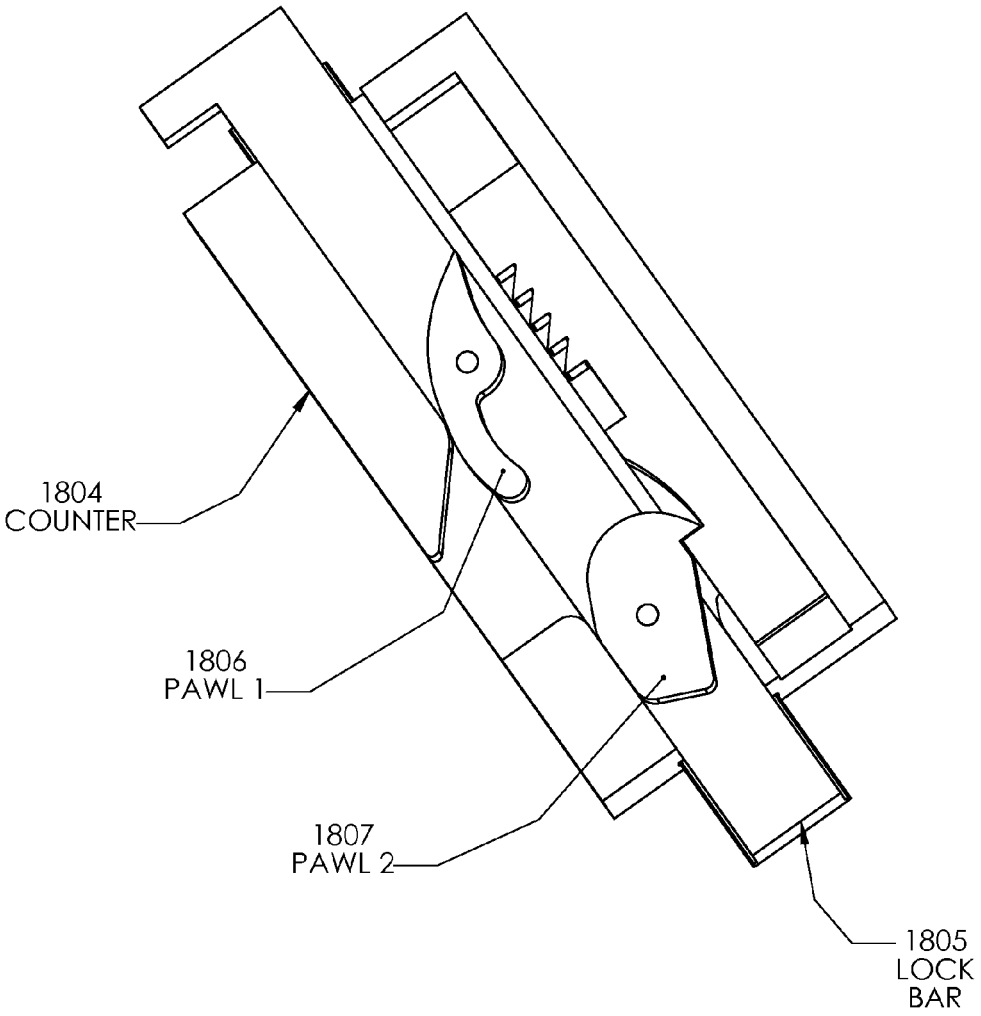
FIG. 20 shows pawl two engaged for the purpose of carrying lock bar rearward for the purpose of resetting the mechanical counter.

FIG. 20 shows pawl two 1807 engaged for the purpose of carrying lock bar 1805 rearward for the purpose of resetting the mechanical counter 1804.

Figure 21:
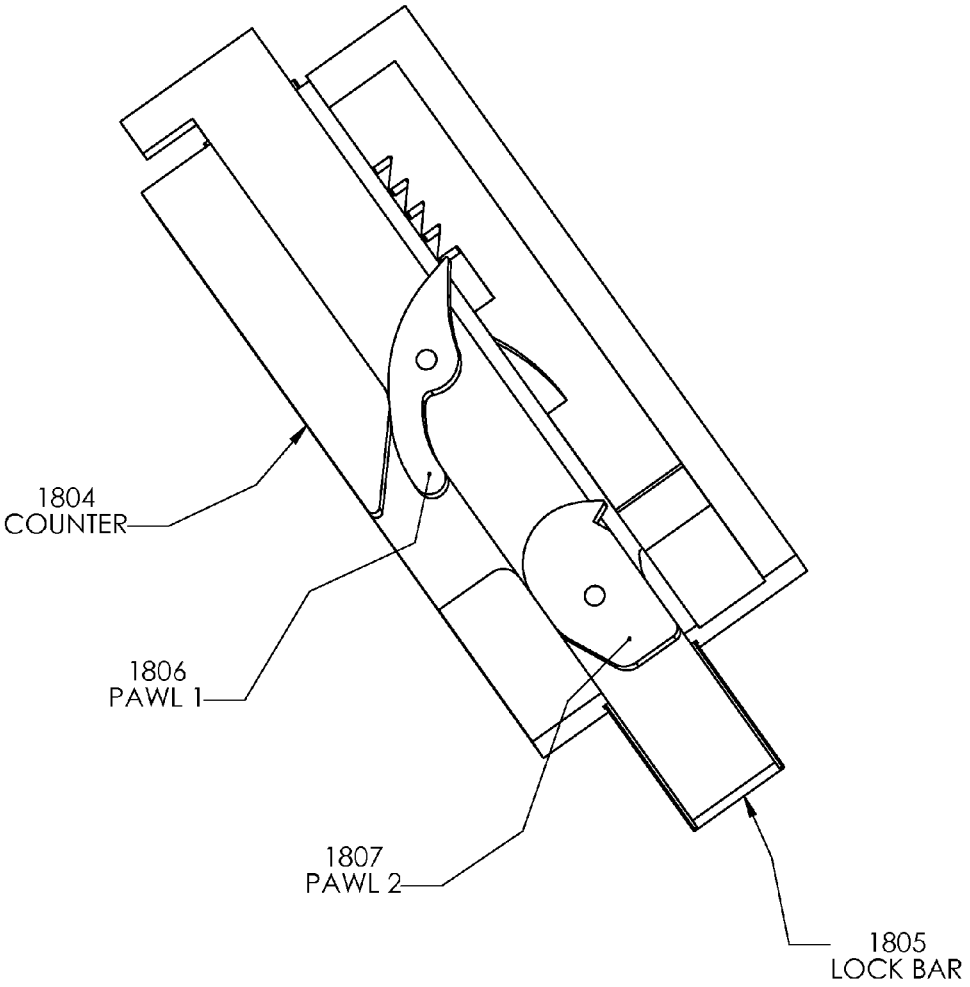
FIG. 21 shows the configuration of the various components in a situation where the counter has had a series of short travel sequences that exceeded a predetermined number.

FIG. 21 shows the configuration of the various components in a situation where the counter 1804 has had a series of short travel sequences that exceeded the number of notches in counter 1804 that could be engaged by pawl one 1806. When this situation occurs, pawl one 1806 in accordance with its design locks lock bar 1805 so that upward travel can no longer be permitted while at the same time. At this time, pawl two 1807 is now put into a position where it can restrict the travel of lock bar 1805 thereby disabling the travel of lock bar 1805 and preventing function of any of the other lock components.

The counter 1804 accepts distance input for the purpose of counting the number of short and long cycles. A short cycle counts up to a certain number then locks into a certain position while a long travel sequence allows the movement upward of lock bar 1805 and the ultimate resetting of counter 1804 to allow another number of attempts.

Figure 22:
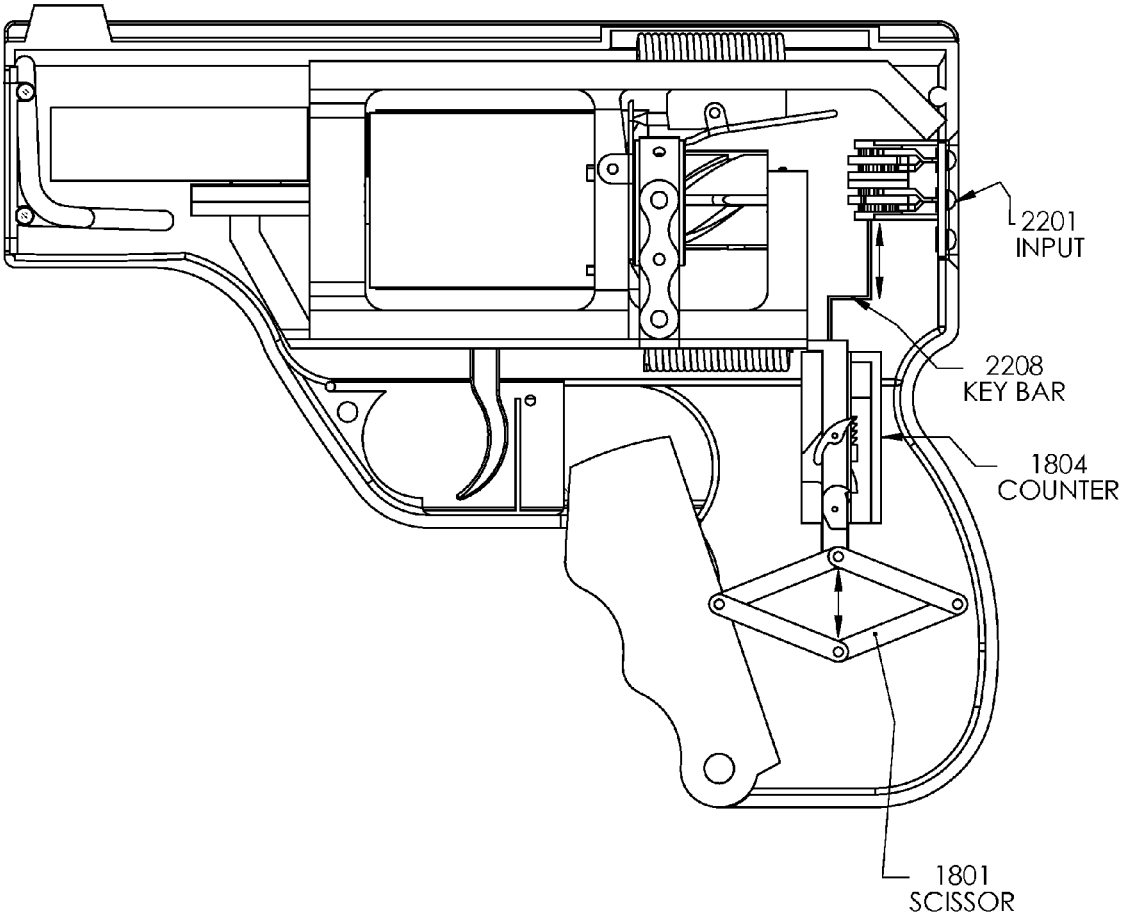
FIG. 22 shows the placement of input which allows the operator to input a series of counts produced by pressing on a button or a switch.

FIG. 22 shows the placement of input 2201 which allows the operator to input a series of counts produced by pressing on a button or a switch. The interior function of input 2201 will be explained later but the interaction between key bar 2208 and counter 1804 can be explained as follows.

Horizontal movement converted to vertical movement by action of scissor 1801 achieves vertical input. This movement is translated into movement of the counter 1804. The vertical movement of the counter 1804 is restricted or allowed by the movement of key bar 2208, which is a bar that allows transfer of movement vertically of counter 1804 into components of input 2201.

The vertical movement of key bar 2208 is restricted by components of input 2201. It can therefore be seen that if key bar 2208 cannot be raised vertically, then the counter 1804 cannot have its interior components move vertically, therefore the other actions of the firearm system 101 are inhibited by the inability of key bar 2208 to move vertically.

The purpose of input 2201 is to provide a counting and sequencing input system that allows or restricts the movement of key bar 2208.

Figure 23:
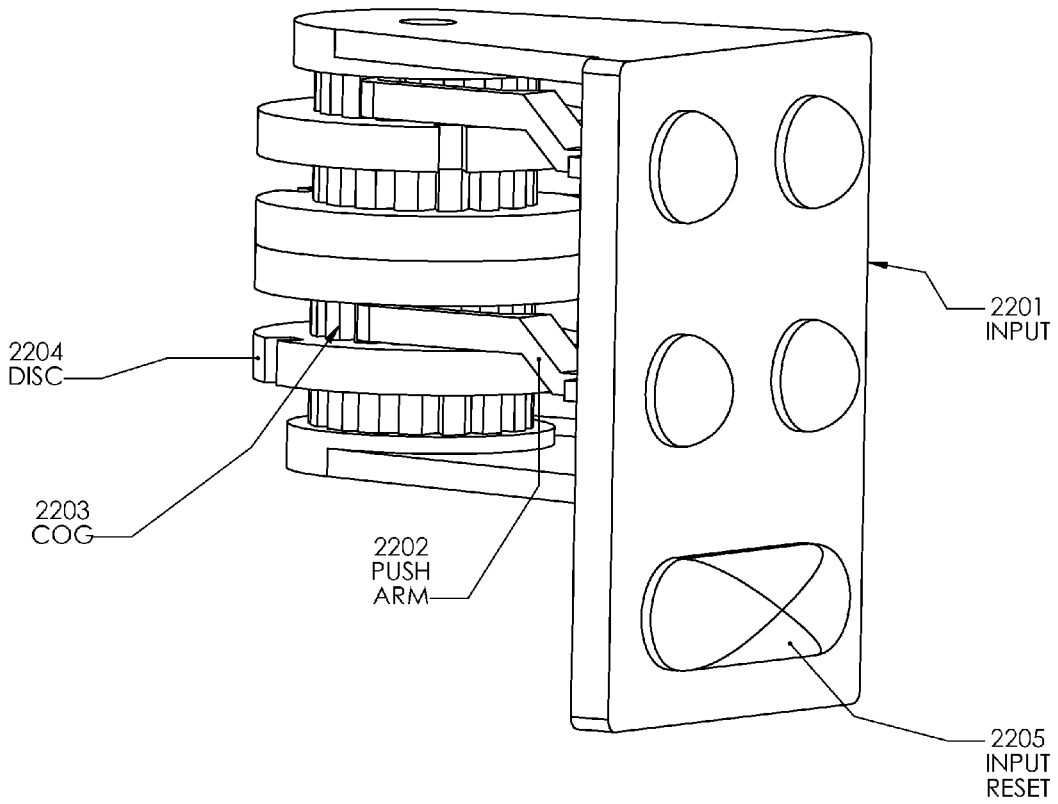
FIG. 23 shows an isometric view of input.

FIG. 23 shows an isometric view of input 2201 which has through its exterior surface the raised portions of push arm 2202 that are spring returned to an outward position so that by pushing on an outward button end, that motion is transferred through push arm 2202 to a shaped tip on push arm 2202 that allows it to engage with a notch on a cog 2203. Cog 2203 sets in relationship to disc 2204 for the purpose of allowing a simple mechanical pin, not shown, to connect the rotary movement of cog 2203 with the ultimate rotary movement of disc 2204. The unshown pin resides on the interior surface between disc 2204 and cog 2203 and is moveable in such a fashion that the relationship between cog 2203 and disc 2204 may be altered for the purpose of setting the count sequence between the various cog notches in cog 2203 and the slot or hole in the exterior of disc 2204.

Shown also in FIG. 23 is input reset 2205. For the purpose of simplicity, the linear bar that constitutes input reset 2205 is not shown. However, it should be easy to understand that input reset 2205 is designed to be pushed at the end of the input sequences on the components of push arm 2202 for the purpose of resetting the entire input system back to zero or resting position.

The input sequence will function as follows: The operator, after exposing the input sequence area by squeezing toward the gun handle grip 104, providing an opening movement so that input 2201 may be revealed to the exterior of the firearm system 101. The operator may then use a digit to press one of the push arm buttons 2202 allowing that each push on push arm 2202, rotates the cog 2203 one increment thereby carrying with it the disc 2204 which contains a slotted or through portion.

Depressing each push arm 2202 on each of the four buttons will allow the corresponding cog 2203 to rotate for the purpose of lining up disc 2204 in a vertical stack with a through slot or opening for the purpose of allowing key bar 2208 to ascend vertically through them thereby constituting a long travel cycle. If the holes or slots in disc 2204 are not aligned, key bar 2208 cannot ascend vertically through its full travel thereby constituting a short travel sequence. A short travel sequence will count as a failed attempt while a long travel sequence will count as a successful attempt thereby allowing the operations of the firearm system 101 to be executed while also applying a reset function to counter 1804.

A portion of disc 2204 will ultimately be exposed during input sequence change to the exterior of the firearm system 101 for the purpose of allowing the operator to change the number of input counts achieved by push arm 2202 to allow alignment of the slot or hole in disc 2204. It should then be easier to understand that input reset 2205, at the moment of moving from safe to firing mode, will clear all push button or push arm inputs 2202, allow cog 2203, and correspondingly disc 2204 to return to a preset zero position which restricts upward movement of key bar 2208 thereby moving the lock portion into safe position.

Figure 24:
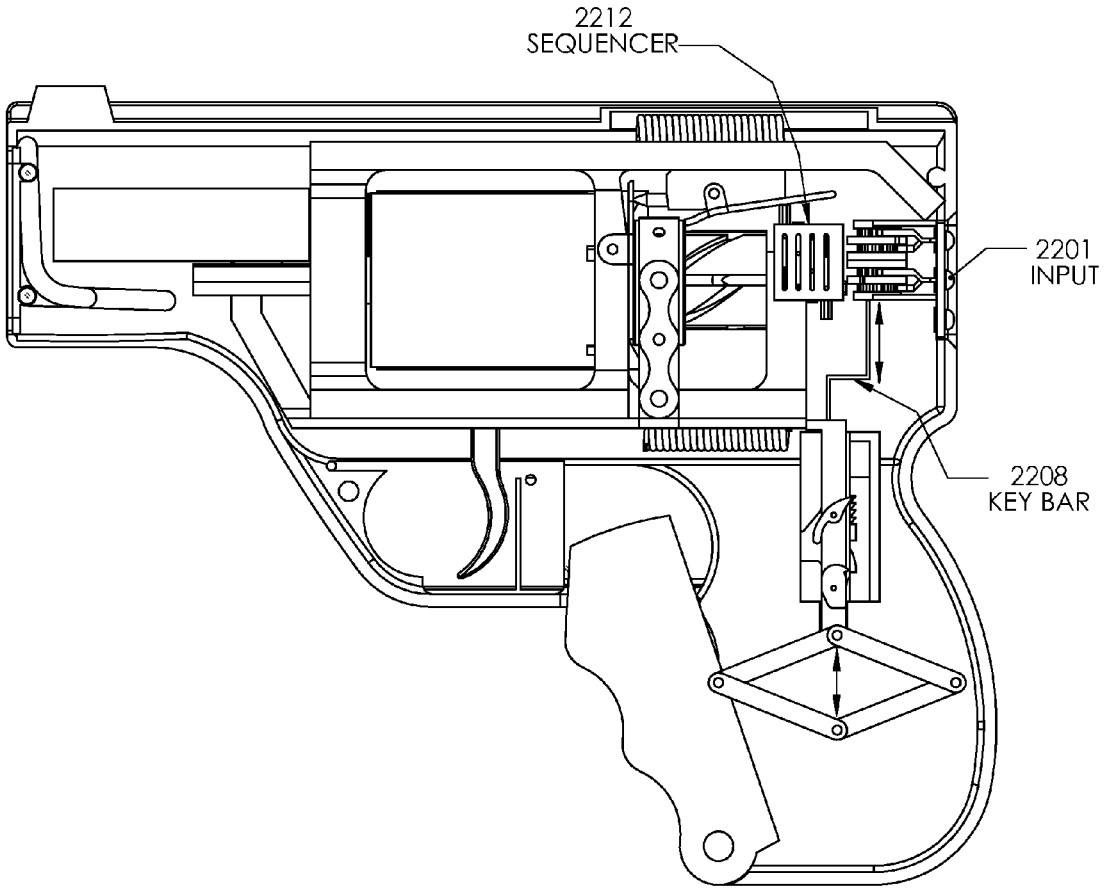
FIG. 24 shows a side view of right shell with the sequencer in the correction location.

FIG. 24 shows a side view of right shell 103 with the sequencer in the correction location. Sequencer 2212 is designed to force into the key input system the requirement for the input 2201 buttons on push arm 2202 to be input in a specific sequence to successfully achieve a long input sequence. The ability to put a sequencing function into this lock system greatly decreases the odds of an unauthorized operator simply inputting the code on the push arm 2202 buttons successfully without knowing the correct count and sequence that has to be applied to input 2201.

It is also envisioned that sequencer 2212 will be exposed to the exterior of firearm system 101 for the purpose of allowing the sequence also to be changed by the operator.

Figure 25:
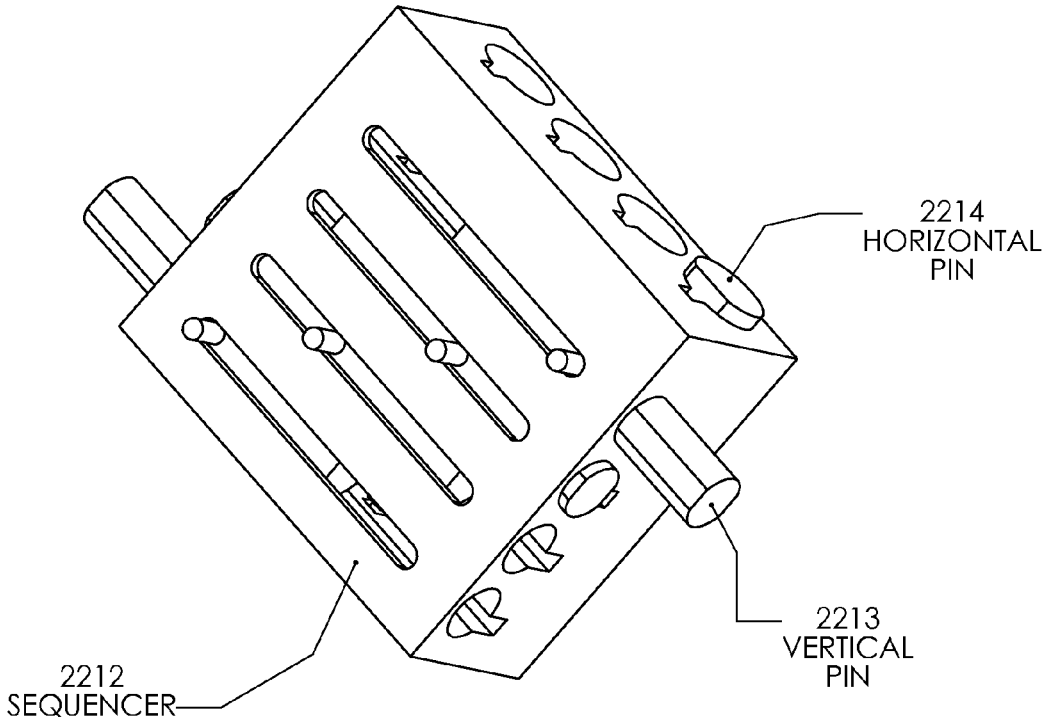
FIG. 25 shows an isometric view of the sequencer.

FIG. 25 shows an isometric view of the sequencer. For the sake of simplicity, the interior components are not shown in detail but the concept is as follows.

Sequencer 2212 has on its interior two rows of pins that are set at 90 degrees to one another. These pins contain on each side a series of notches, which are designed so that the pins, both horizontal and vertical, may be put into place with one another and spring pressure applied to them. Due to the notches, the pins must fall in a given sequence in order to move outward from the block.

FIG. 25 shows the location of the four vertical pins 2213 trapped inside their cavities and shown in relationship to the four horizontal pins 2214 shown trapped inside their cavities as well. The vertical pin 2213 has on the opposite side from the notches an external pin shown moved outward from its surface for the purpose of allowing vertical pin 2213 to be physically moved up and down inside the slot shown inside sequencer 2212. The operator sets the sequence whereby horizontal pins 2214, under spring tension, to move outward from the block.

The sequencer 2212 is a very simple pre-settable cascade device, which allows the horizontal pins 2214 to exit in a single step in sequence. The movement of vertical pin 2213 and its notch will allow a horizontal pin 2214 to move forward, which allows another vertical pin 2213 to move; when it moves the notch will allow, by cascade, another horizontal pin 2214 to exit the body. The purpose of this sequence so that a notch in the end of horizontal pin 2214 will move forward and engage cog 2203 on the input 2201.

Thus follows that when the operator presses on push arm 2202, if the cascading sequence horizontal pin 2214 is the correct sequence to that particular cog 2203, then each time push arm 2203 is pressed the cog 2203 will move forward one notch and the correct horizontal pin 2214 will catch and latch that cog 2203 in position. It is envisioned that multiple teeth will be applied to cog 2203 therefore if horizontal pin 2214 is acting as a latch, the number of inputs from push arm 2202 will be counted and latched onto that cog 2203 for the purpose of holding it.

With the above sequencing, it follows that each time an input is applied to push arm 2202 it will rotate cog 2203. If that cog 2203 is in the correct sequence with its corresponding horizontal pin 2213, that cog 2203 will latch thereby allowing an individual to apply motions that will ultimately hold and latch so that all four discs 2204 will be in alignment so that an attempt by key bar 2208 to ascend vertically will be successful. If the input 2201 is not pressed in the correct sequence, the cog 2203 will not latch, thereby allowing disc 2204 to align all four of the internal openings so that key bar 208 may perform a long travel sequence.

Figure 26:
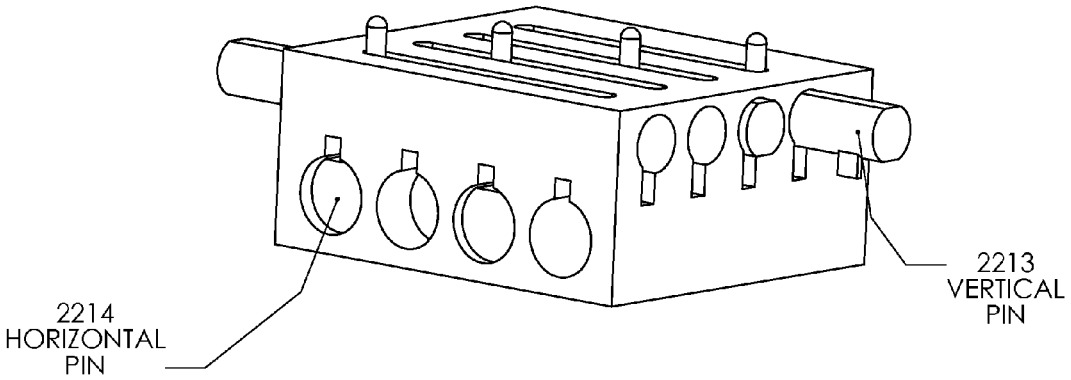
FIG. 26 shows a side view of the sequencer.

FIG. 26 shows a side view of the sequencer 2212 and the slotted portions on the interior of the cavities of the sequencer 2212 which align and correspond with portions of the vertical pins 2213 and horizontal pins 2213 for the purpose of allowing them to bypass one another when set in the correct bypass mode.

It should now be apparent that input reset 2205 is also intended to travel across during its depression and reset by virtue of a mechanical system, not shown, the positioning of the various components of the sequencer 2212.

Therefore a simple description of the lock is as follows: The operator will press on the buttons for the correct count and the correct sequence thereby allowing the various lock components to be placed in either a long travel sequence or a short travel sequence. If the operator inputs the correct code and count, they have five attempts; at which time the lock will default to a mechanical position that it will no longer accept input and is locked. This situation is anticipated to require disassembly of firearm system 101 to reset.

If, however, the operator correctly inputs the correct number of counts and sequencing on the buttons, and then pushes input reset 2205, the key bar 2208 will be allowed to rise vertically therefore constituting a long travel sequence and the various components previously described inside firearm system 101 will be allowed to function correctly.

Figure 27:
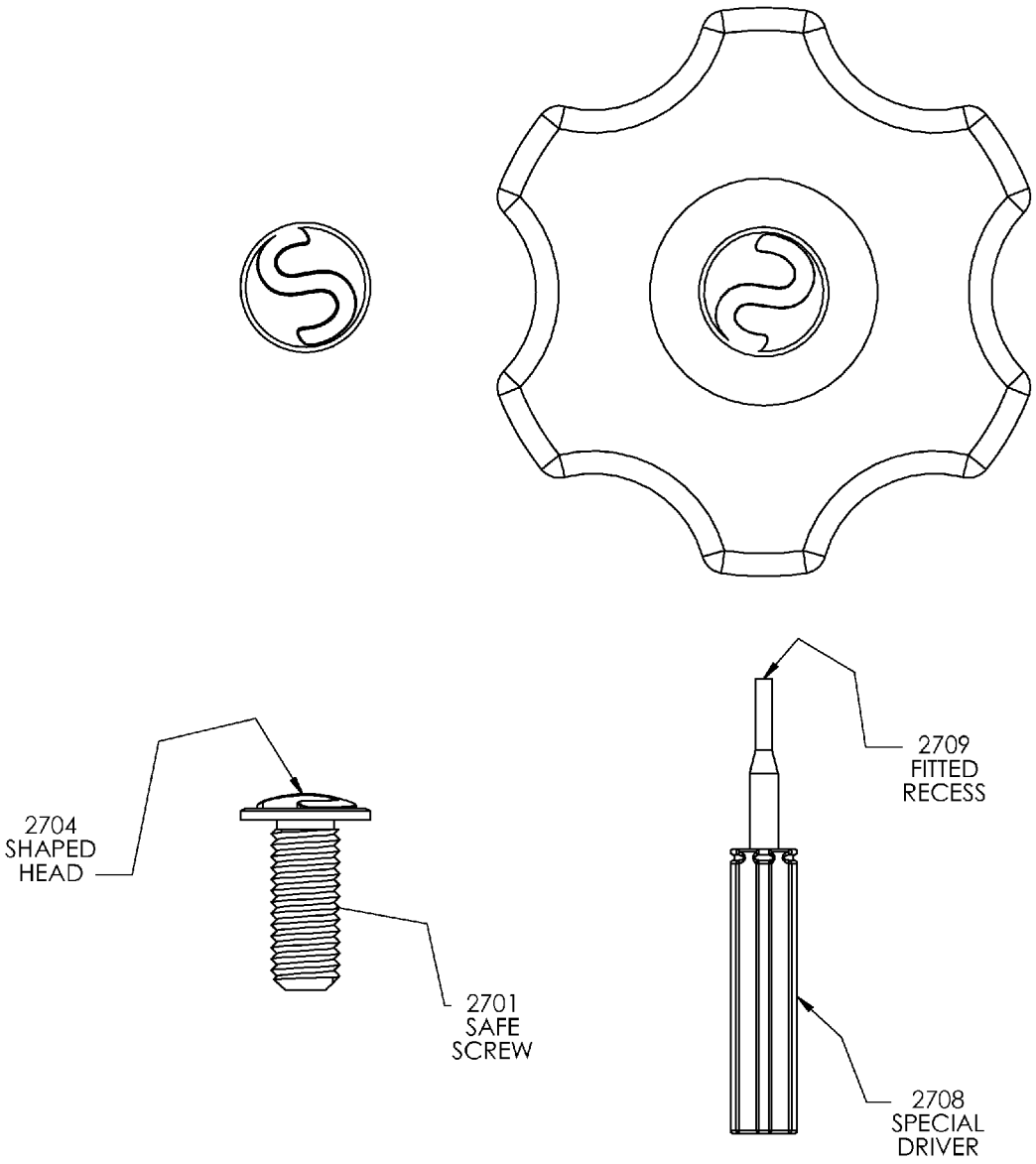
FIG. 27 shows a view of safe screw and special driver.

FIG. 27 shows a view of safe screw 2701 and special driver 2708. As previously described the frame portions left shell 102 and right shell 103 of the firearm system 101 are held together by a series of safe screws 2701 that prevent removal without customized tooling.

On the market there are several tamper resistant screws, rivets, or other means of assembly that could be envisioned for assembling the firearm system 101. However, due to the need to reset the firearm system 101 in case of accidental, multiple, incorrect code attempts it is envisioned and described here that a shaped head 2704 designed with a very low attack or grab angle is manufactured and used to assemble the exterior portions of the frame shells, right shell 102 and left shell 103, of the firearm system 101. Also shown in FIG. 27 is the fitted recess 2709 that engages the low angle features of the shaped head 2704 for the purpose of allowing a rotary motion to be applied to them. It is envisioned that the special driver 2708 would be held in a mechanism that required an incredible amount of pressure to be applied to the shaped head 2704 for the purpose of installation or removal of safe screw 2701.

What is claimed is:

1. A safety-oriented firearm system, comprising:

a cylinder, barrel, and frame capable of containing and firing an ammunition cartridge;

an aligned and sliding linear hammer which moves only in a straight line from beginning of travel to end of travel and which is moved by a linear hammer spring to strike a primer to achieve detonation;

the cylinder and a rotating drum connected by a surfaced rod, which allows the transfer of movement of a trigger bar via the rotating drum and a single point driver pin thereby driving the cylinder to release the linear hammer; and a left shell and a right shell which form two exterior halves of the firearm system and are held together by a plurality of tamper proof screws;

wherein the cylinder, barrel, and frame become non-functional if disassembled and wherein the cylinder, barrel, and frame are prevented from re-assembly by the tamper proof screws.

2. The system of claim 1, further comprising:

the system having a safe mode, a firing mode, and a loading mode;

a safety plate which prevents the linear hammer from advancing toward the ammunition cartridge while the system is in the safe mode, by producing a physical gap between the hammer and a primer portion of the ammunition cartridge.

3. The system of claim 2, further comprising:

the safety plate moves about a pivot thereby physically restraining the linear hammer during safe mode and preventing the hammer from touching the ammunition cartridge unless a driver has been moved rearward by a linear force from the trigger bar.

4. The system of claim 2, further comprising:

the trigger bar being positioned such that linear trigger pressure on the trigger bar is transferred to the drive drum and to the linear hammer against spring resistance from the linear hammer spring;

the linear hammer having a moving portion and a hammer lever incorporated therein;

the hammer lever being configured to engage an angled surface of the frame;

wherein the linear hammer is released to strike the primer only after engaging the angled surfaced of the frame.

5. The system of claim 1, further comprising:

a mechanical action that is inseparable from the firearm system so that the mechanical action cannot be used as a standalone firearm.

6. The system of claim 1, further comprising:

wherein the barrel is attached to the left shell by either threaded connection or welded connection.

7. The system of claim 6, further comprising:

wherein the left shell and right shell form an opening to allow a hex pin to penetrate therethrough, and further wherein the cylinder and the drive drum have hexagon-shaped openings to engage the hex pin.

8. The system of claim 1, further comprising:

a selector switch for moving the system to and from safe mode, firing mode, and loading mode.

9. The system of claim 1, further comprising:

the cylinder, barrel, and frame are connected to the trigger bar which is in turn connected to a lock bar, the lock bar limiting function of the firearm unless a lock has been correctly enabled.

* * * * *